US009195179B2

(12) United States Patent
Shimizu et al.

(10) Patent No.: US 9,195,179 B2
(45) Date of Patent: Nov. 24, 2015

(54) TRANSFER DEVICE AND IMAGE FORMING APPARATUS INCLUDING SAME

(71) Applicants: Yasunobu Shimizu, Kanagawa (JP); Shinya Tanaka, Kanagawa (JP); Hiromi Ogiyama, Tokyo (JP); Hirokazu Ishii, Tokyo (JP); Keigo Nakamura, Kanagawa (JP)

(72) Inventors: Yasunobu Shimizu, Kanagawa (JP); Shinya Tanaka, Kanagawa (JP); Hiromi Ogiyama, Tokyo (JP); Hirokazu Ishii, Tokyo (JP); Keigo Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 134 days.

(21) Appl. No.: 13/747,629

(22) Filed: Jan. 23, 2013

(65) Prior Publication Data

US 2013/0195483 A1 Aug. 1, 2013

(30) Foreign Application Priority Data

Jan. 26, 2012 (JP) ..... 2012-014204

(51) Int. Cl.
*G03G 15/16* (2006.01)
*G03G 15/00* (2006.01)
*G03G 15/01* (2006.01)

(52) U.S. Cl.
CPC ..... *G03G 15/1645* (2013.01); *G03G 15/0189* (2013.01); *G03G 15/1605* (2013.01); *G03G 15/5029* (2013.01); *G03G 2215/00751* (2013.01)

(58) Field of Classification Search
CPC ..... G03G 15/5029; G03G 2215/00751; G03G 15/0827; G03G 15/1675; G03G 15/1605; G03G 15/0131; G03G 2215/00949; G03G 2215/0196
USPC ..... 399/45, 66
See application file for complete search history.

(56) References Cited

U.S. PATENT DOCUMENTS 4,134,147 A * 1/1979 Watanabe ..... 361/235
5,486,903 A * 1/1996 Kanno et al. ..... 399/45
5,995,802 A * 11/1999 Mori et al. ..... 399/394

(Continued)

FOREIGN PATENT DOCUMENTS

CN 101295150 A 10/2008
JP 4-086878 3/1992

(Continued)

OTHER PUBLICATIONS

Office Action issued Feb. 3, 2015 in Chinese Patent Application No. 201310021675.X.

*Primary Examiner* — Christopher Mahoney
(74) *Attorney, Agent, or Firm* — Oblon, McClelland, Maier & Neustadt, L.L.P.

(57) ABSTRACT

A transfer device includes a transfer bias power source, a switching device, and a sheet dependent condition setting device. The transfer bias power source applies to a transfer member, based on sheet dependent conditions for a recording medium onto which a toner image is transferred, one of a DC transfer bias and a superimposed transfer bias including an alternating current (AC) component superimposed on a DC component. The switching device switches a transfer mode between a DC transfer mode in which the DC transfer bias is applied to the transfer device and a superimposed-bias transfer mode in which the superimposed transfer bias is applied to the transfer device. The sheet dependent condition setting device sets arbitrarily at least one of the sheet dependent conditions for the recording medium at the superimposed-bias transfer mode. The sheet dependent conditions include a DC component value and an AC component value.

11 Claims, 12 Drawing Sheets

(56) References Cited

U.S. PATENT DOCUMENTS

| | | | | |
|---|---|---|---|---|
| 8,027,603 | B2 * | 9/2011 | Fromm | 399/45 |
| 2005/0254847 | A1 * | 11/2005 | Kietzman et al. | 399/68 |
| 2007/0009293 | A1 * | 1/2007 | Akiba et al. | 399/350 |
| 2007/0104502 | A1 * | 5/2007 | Ogihara et al. | 399/66 |
| 2010/0329707 | A1 * | 12/2010 | Yamada | 399/44 |
| 2011/0229168 | A1 | 9/2011 | Shiraishi et al. | |
| 2012/0045231 | A1 * | 2/2012 | Ogino et al. | 399/45 |
| 2012/0045237 | A1 | 2/2012 | Aoki et al. | |
| 2012/0045259 | A1 | 2/2012 | Nakamura et al. | |
| 2012/0230715 | A1 | 9/2012 | Ogino et al. | |
| 2012/0237234 | A1 | 9/2012 | Sugimoto et al. | |
| 2012/0237271 | A1 | 9/2012 | Sengoku et al. | |
| 2012/0243892 | A1 | 9/2012 | Nakamura et al. | |
| 2012/0308250 | A1 | 12/2012 | Shimizu et al. | |
| 2012/0315058 | A1 | 12/2012 | Shimizu et al. | |
| 2012/0321336 | A1 | 12/2012 | Ogiyama | |
| 2012/0328314 | A1 | 12/2012 | Sugimoto et al. | |
| 2012/0328315 | A1 | 12/2012 | Takeuchi et al. | |
| 2012/0328320 | A1 | 12/2012 | Fujita et al. | |
| 2012/0328321 | A1 | 12/2012 | Takeuchi et al. | |
| 2013/0004190 | A1 | 1/2013 | Sengoku et al. | |
| 2013/0011155 | A1 * | 1/2013 | Ogiyama et al. | 399/66 |
| 2013/0016989 | A1 | 1/2013 | Fujita et al. | |
| 2014/0010562 | A1 * | 1/2014 | Tanaka et al. | 399/66 |
| 2014/0079423 | A1 * | 3/2014 | Shiraishi et al. | 399/66 |
| 2014/0169817 | A1 * | 6/2014 | Sugimoto et al. | 399/66 |

FOREIGN PATENT DOCUMENTS

| | | |
|---|---|---|
| JP | 9-146381 | 6/1997 |
| JP | 2003-270872 | 9/2003 |
| JP | 2006-267486 | 10/2006 |
| JP | 2008-058585 | 3/2008 |

* cited by examiner

FIG. 8

CALL SHEET DATABASE CLOSE

SELECT SHEET TO REGISTER AS USER SHEET

| | |
|---|---|
| 001 | FULL-COLOR PPC SHEET TYPE 6000 < 70W > (80 gsm) RICOH |
| 002 | LEATHAC 66 100 kg (116 gsm)<br>SPECIAL SHEET (SUPERIMPOSED-BIAS TRANSFER MODE) |
| 003 | LEATHAC 66 100 kg (116 gsm)<br>SPECIAL SHEET (DC TRANSFER MODE) |
| 004 | Tidal MP 20 lb (75 gsm) Hammermill |
| 005 | Color Copy (120 gsm) Mondi |

△ PREVIOUS ▼ NEXT

TRANSFER DEVICE AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application No. 2012-014204, filed on Jan. 26, 2012, in the Japan Patent Office, the entire disclosure of which is hereby incorporated by reference herein.

BACKGROUND OF THE INVENTION

1. Field of the Invention

Exemplary aspects of the present invention generally relate to a transfer device that transfers a toner image formed on an image bearing member to a recording medium and an image forming apparatus including the transfer device.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photosensitive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

Known image forming apparatuses using an intermediate transfer method typically employ a belt-type intermediate transfer member (hereinafter simply referred to as intermediate transfer belt) formed into an endless loop that contacts the photosensitive member, thereby forming a primary transfer nip therebetween. In the primary transfer nip, a toner image formed on the photosensitive member is transferred primarily onto the intermediate transfer belt by a transfer device.

A secondary transfer roller serving as a nip forming member contacts the intermediate transfer belt, forming a secondary transfer nip therebetween, so that the toner image on the intermediate transfer belt is secondarily transferred onto a recording medium in a process known as "secondary transfer process". A secondary transfer opposed roller is disposed inside the loop formed by the intermediate transfer belt, facing the secondary transfer roller with the intermediate transfer belt interposed therebetween. The secondary transfer opposed roller disposed inside the loop of the intermediate transfer belt is grounded; whereas, the secondary transfer roller disposed outside the loop is supplied with a secondary transfer bias.

With this configuration, a secondary transfer electric field that electrostatically transfers the toner image from the secondary transfer opposed roller side to secondary transfer roller side is formed. The secondary transfer electric field causes the toner image on the intermediate transfer belt to move to a recording medium fed to the secondary transfer nip in appropriate timing such that the recording medium is aligned with the toner image formed on the intermediate transfer belt.

In recent years, a variety of recording media sheets such as paper having a luxurious, leather-like texture and Japanese paper known as "Washi" have come on the market. Such recording media sheets have a coarse surface through embossing process to produce that luxurious impression. Hereinafter, the recording medium having a coarse or embossed surface is referred to as a textured sheet. However, toner does not transfer well to such embossed surfaces, in particular the recessed portions of the surface. This improper transfer of the toner appears as dropouts or white spots in the resulting output image.

Various attempts have been made to prevent improper transfer of the toner under such circumstances. For example, a superimposed bias, in which an alternating current (AC) voltage is superimposed on a direct current (DC) voltage, is supplied as a secondary transfer bias in a superimposed-bias transfer mode to enhance transferability. Depending on the type of the recording medium, the transfer mode can be switched between a DC transfer mode in which a voltage with a DC component is applied to a transfer member and the superimposed-bias transfer mode, thereby transferring sufficiently the toner onto a recording medium regardless of the surface conditions of the recording medium. In the superimposed-bias transfer mode, the superimposed bias, in which a voltage having a predetermined AC component is superimposed on a voltage having a predetermined DC component, is applied to a metal core of a transfer roller serving as a transfer member. Accordingly, good transferability can be achieved for the textured sheet.

Although advantageous and generally effective for its intended purpose, the degree of roughness or the depth of recessed portions of the surface of the textured sheet varies, and thus parameters for image formation, in particular, parameters (hereinafter referred to as sheet dependent conditions) such as a DC component voltage, an AC component voltage, a fixing temperature, and a sheet conveyance speed that depend on the conditions of the sheet also vary. Consequently, in the superimposed-bias transfer mode, it is difficult to set the sheet dependent conditions at a certain level that accommodate all types of sheets. In particular, the voltage having the AC component affects transferability of toner to the recessed portions of the sheet surface, while the voltage having the DC component affects transferability of toner to the projecting portions. If a toner image is transferred based on a set of preset sheet dependent conditions, the preset sheet dependent conditions may be different from desired sheet dependent conditions for a present sheet to be used, and the toner may not be transferred adequately to the recessed portions of the surface of the sheet, causing image defects such as dropouts of toner or blank spots in the resulting image.

Similarly, in an image forming apparatus using a direct transfer method in which the toner image is directly transferred from the photosensitive member to a recording medium, the toner may not be transferred well from the photosensitive member to the recording medium.

In view of the above, there is an unsolved need for an image forming apparatus that is capable of providing good imaging quality regardless of conditions of a recording medium when using a superimposed bias as a transfer bias.

SUMMARY OF THE INVENTION

In view of the foregoing, in an aspect of this disclosure, there is provided an improved transfer device including a transfer member, a transfer bias power source, a switching device, and a sheet dependent condition setting device. The transfer member transfers a toner image formed on an image bearing member onto a recording medium. The transfer bias power source applies to the transfer member one of a direct-current (DC) transfer bias including a DC component and a superimposed transfer bias in which an alternating current (AC) component is superimposed on a DC component based on sheet dependent conditions for the recording medium onto which the toner image is transferred. The switching device switches a transfer mode between a DC transfer mode in which the DC transfer bias is applied to the transfer device to transfer the toner image onto the recording medium and a superimposed-bias transfer mode in which the superimposed transfer bias is applied to the transfer device to transfer the toner image onto the recording medium. The sheet dependent condition setting device sets arbitrarily at least one of the sheet dependent conditions for the recording medium at the superimposed-bias transfer mode. The sheet dependent conditions include a DC component value and an AC component value.

According to another aspect, an image forming apparatus includes an image bearing member, a transfer member, a transfer bias power source, and a sheet dependent condition setting device. The image bearing member bears a toner image on a surface thereof. The transfer member transfers the toner image formed on the image bearing member onto a recording medium. The transfer bias power source applies to the transfer member, based on sheet dependent conditions for the recording medium onto which the toner image is transferred, a superimposed transfer bias in which an alternating current (AC) component is superimposed on a direct current (DC) component. The sheet dependent condition setting device sets arbitrarily at least one of the sheet dependent conditions for the recording medium. The sheet dependent conditions include a DC component value and an AC component value.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 8 is a schematic diagram illustrating a dialog box for calling a sheet database;

DETAILED DESCRIPTION OF THE INVENTION

Figure 1:
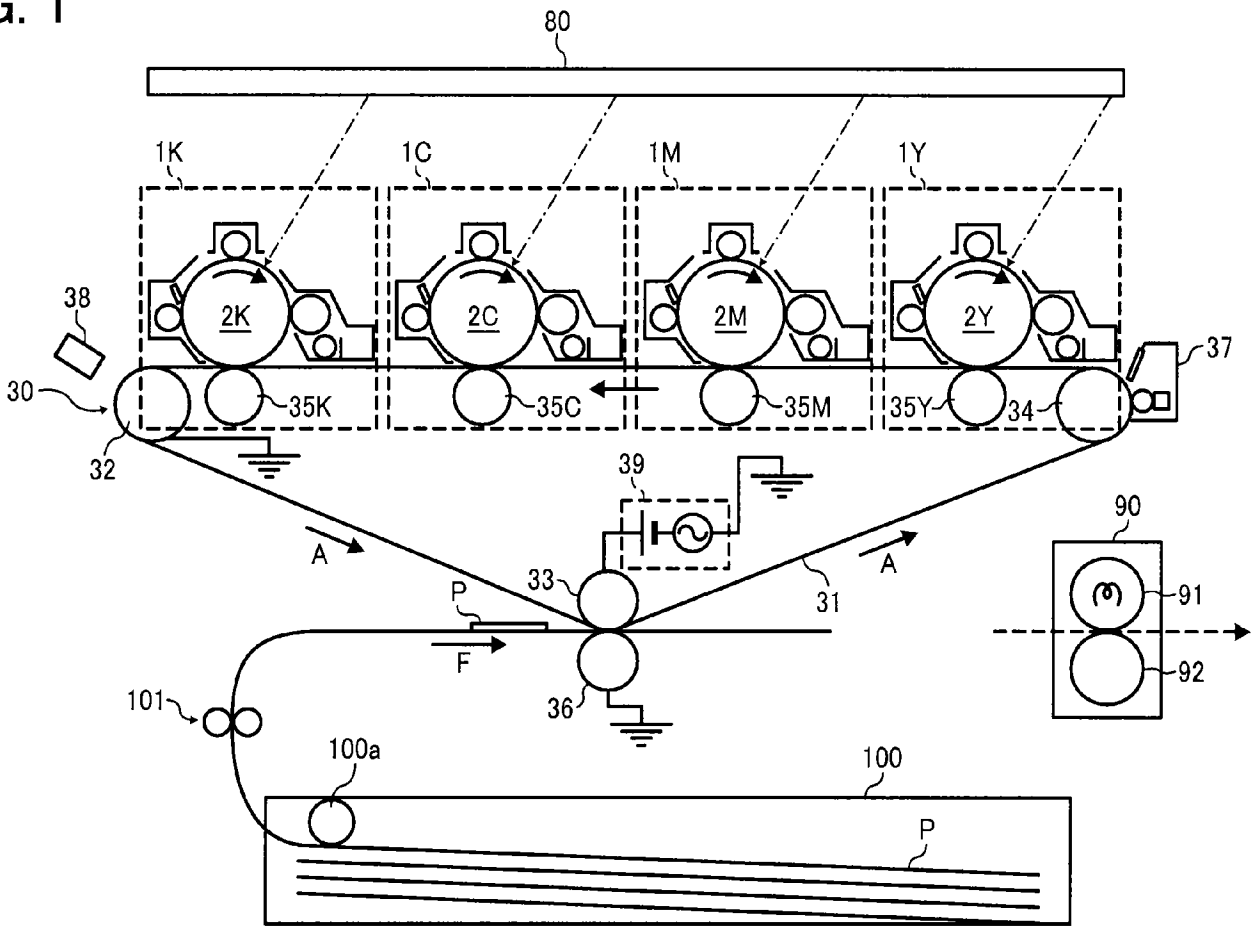
FIG. 1 is a schematic diagram illustrating a printer as an example of an image forming apparatus according to the an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an electrophotographic color copier as an example of an image forming apparatus according to an illustrative embodiment of the present invention.

FIG. 1 is a schematic diagram illustrating the image forming apparatus. As illustrated in FIG. 1, the image forming apparatus includes four image forming units 1Y, 1M, 1C, and 1K for forming toner images, one for each of the colors yellow, magenta, cyan, and black, respectively, a transfer unit 30, an optical writing unit 80, a fixing device 90, a sheet cassette 100, and a pair of registration rollers 101. The order of image forming units 1Y, 1M, 1C, and 1K is not limited to this. It is to be noted that the suffixes Y, M, C, and K denote colors yellow, magenta, cyan, and black, respectively. To simplify the description, these suffixes Y, M, C, and K indicating colors are omitted herein, unless otherwise specified. The optical writing unit 80 is disposed substantially above the image forming units 1Y, 1M, 1C, and 1K. The sheet cassette 100 is disposed at the bottom of the image forming apparatus. The fixing device 90 is disposed downstream from the transfer unit 30 in the direction of transport of the recording medium indicated by arrow A.

The image forming units 1Y, 1M, 1C, and 1K all have the same configuration as all the others, differing only in the color of toner employed. Thus, a description is provided of the image forming unit 1K for forming a toner image of black as a representative example of the image forming units 1. The image forming units 1Y, 1M, 1C, and 1K can be replaced upon reaching their product life cycles.

Figure 2:
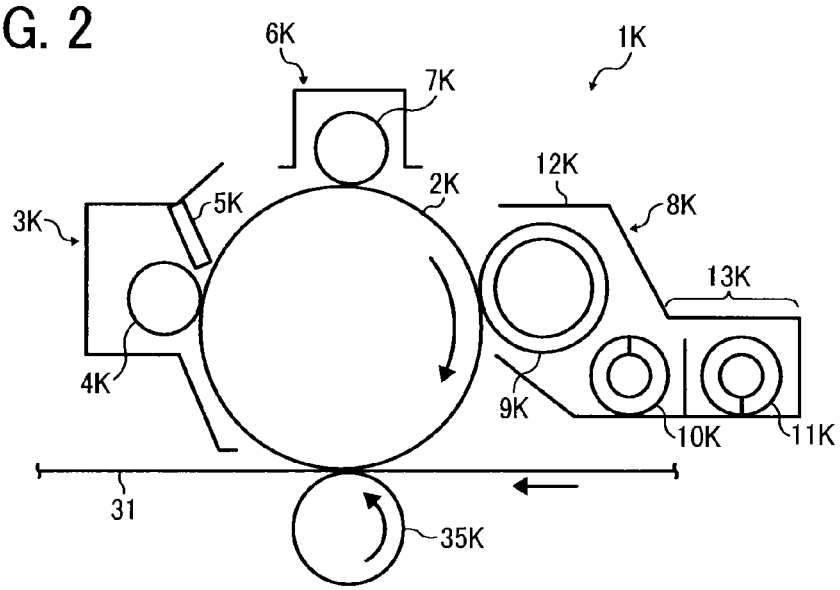
FIG. 2 is an enlarged schematic diagram illustrating an image forming unit for black as an example of image forming units employed in the image forming apparatus of FIG. 1.

With reference to FIG. 2, a description is provided of the image forming unit 1K as an example of the image forming units. FIG. 2 is a schematic diagram illustrating the image forming unit 1K. The image forming unit 1K includes a photosensitive drum 2K serving as a latent image bearing member surrounded by various pieces of imaging equipment, such as a charging device 6K, a developing device 8K, a drum cleaner 3K, and a charge neutralizing device (not illustrated). These devices are held by a common holder so that they are detachably attachable and replaced at the same time.

The photosensitive drum 2K comprises a drum-shaped base on which an organic photosensitive layer is disposed, with the external diameter of approximately 60 mm. The photosensitive drum 2K is rotated in a clockwise direction indicated by an arrow by a driving device. The charging device 6K includes a charging roller 7K supplied with a charging bias. The charging roller 7K contacts or approaches the photosensitive drum 2K to generate electrical discharge therebetween, thereby charging uniformly the surface of the photosensitive drum 2K. According to the present illustrative embodiment, the photosensitive drum 11 is uniformly charged to a negative polarity which is the same polarity as the normal charging polarity of toner. As the charging bias, an alternating current (AC) voltage superimposed on a direct current (DC) voltage is employed. The charging roller 7K comprises a metal cored bar coated with a conductive elastic layer made of a conductive elastic material. According to the present embodiment, the photosensitive drum 2K is charged by the charging roller 7K contacting the photosensitive drum 2K or disposed near the photosensitive drum 2K. Alternatively, a corona charger or any other suitable charger may be employed.

The uniformly charged surface of the photosensitive drum 2K is scanned by a light beam projected from the optical writing unit 80, thereby forming an electrostatic latent image for black on the surface of the photosensitive drum 2K. The electrostatic latent image for black on the photosensitive drum 2K is developed with black toner by the developing device 8K. Accordingly, a visible image, also known as a toner image of black, is formed. As will be described later, the toner image is transferred primarily onto an intermediate transfer belt 31.

The drum cleaner 3K removes residual toner remaining on the photosensitive drum 2K after the primary transfer process, that is, after the photosensitive drum 2K passes through a primary transfer nip at which the photosensitive drum 2K contacts the intermediate transfer belt 31. The drum cleaner 3K includes a brush roller 4K and a cleaning blade 5K. The cleaning blade 5K is cantilevered, that is, one end of the cleaning blade is fixed to the housing of the drum cleaner 3K, and its free end contacts the surface of the photosensitive drum 2K. The brush roller 4K rotates and brushes off the residual toner from the surface of the photosensitive drum 2K while the cleaning blade 5K removes the residual toner by scraping. It is to be noted that the cantilevered side of the cleaning blade 5K is positioned downstream from its free end contacting the photosensitive drum 2K in the direction of rotation of the photosensitive drum 2K so that the free end of the cleaning blade 5K faces or becomes counter to the direction of rotation.

The charge neutralizer removes residual charge remaining on the photosensitive drum 2K after the surface thereof is cleaned by the drum cleaner 3K in preparation for the subsequent imaging cycle. The surface of the photosensitive drum 2K is initialized in preparation for the subsequent imaging cycle.

The developing device 8K includes a developing portion 12K and a developer conveyer 13K. The developing portion 12K includes a developing roller 9K inside thereof. The developer conveyer 13K mixes and delivers a developing agent for black. The developer conveyer 13K includes a first chamber equipped with a first screw 10K and a second chamber equipped with a second screw 11K. The first screw 10K and the second screw 11K are each constituted of a rotatable shaft and helical flighting wrapped around the circumferential surface of the shaft. Each end of the shaft of the first screw 10K and the second screw 11K are rotatably held by shaft bearings.

The first chamber with the first screw 10K and the second chamber with the second screw 11K are separated by a wall, but each end of the wall in the direction of the screw shaft has a connecting hole through which the first chamber and the second chamber are connected. The first screw 10K mixes the developing agent by rotating the helical flighting and carries the developing agent from the distal end to the proximal end of the screw in the direction perpendicular to the surface of the recording medium while rotating. The first screw 10K is disposed parallel to and facing the developing roller 9K. Hence, the developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K passes through the connecting hole in the wall near the proximal side and enters the second chamber. Subsequently, the developing agent is carried by the helical flighting of the second screw 11K. As the second screw 11K rotates, the developing agent is delivered from the proximal end to the distal end in FIG. 2 while being mixed in the direction of rotation.

In the second chamber, a toner detector for detecting the density of toner in the developing agent is disposed at the bottom of a casing of the chamber. As the toner density detector, a magnetic permeability detector is employed. There is a correlation between the toner density and the magnetic permeability of the developing agent consisting of a toner and a magnetic carrier. Therefore, the magnetic permeability detector can detect the density of the toner.

Although not illustrated, the image forming apparatus includes toner supply devices to independently supply toner of yellow, magenta, cyan, and black to the second chamber of the respective developing device 8. A control unit of the image forming apparatus includes a Random Access Memory (RAM) to store a target output voltage Vtref for output voltages provided by the toner density detectors for yellow, magenta, cyan, and black. If the difference between the output voltages provided by the toner detectors for yellow, magenta, cyan, and black and Vtref for each color exceeds a predetermined value, the toner supply devices are driven for a predetermined time period corresponding to the difference to supply toner. Accordingly, the respective color of toner is supplied to the second chamber of the developing device 8.

The developing roller 9K in the developing portion 12K faces the first screw 10K and also the photosensitive drum 2K through an opening formed in the casing of the developing device 8K. The developing roller 9K comprises a cylindrical developing sleeve made of a non-magnetic pipe which is rotated, and a magnetic roller disposed inside the developing sleeve. The magnetic roller is fixed to prevent the magnetic roller from rotating together with the developing sleeve. The developing agent supplied from the first screw 10K is carried on the surface of the developing sleeve by the magnetic force of the magnetic roller. As the developing sleeve rotates, the developing agent is transported to a developing area facing the photosensitive drum 2K.

The developing sleeve is supplied with a developing bias having the same polarity as toner. The developing bias is greater than the bias of the electrostatic latent image on the photosensitive drum 2K, but less than the charging potential of the uniformly charged photosensitive drum 2K. With this configuration, a developing potential that causes the toner on the developing sleeve to move electrostatically to the electrostatic latent image on the photosensitive drum 2K acts between the developing sleeve and the electrostatic latent image on the photosensitive drum 2K. A non-developing potential acts between the developing sleeve and the non-image formation areas of the photosensitive drum 2K, causing the toner on the developing sleeve to move to the sleeve surface. Due to the developing potential and the non-developing potential, the black toner on the developing sleeve moves selectively to the electrostatic latent image formed on the photosensitive drum 2K, thereby forming a visible image, known as a toner image of black.

Similar to the image forming unit 1K, in the image forming units 1Y, 1M, and 1C, toner images of yellow, magenta, and cyan are formed on photosensitive drums 2Y, 2M, and 2C (illustrated in FIG. 1), respectively.

The optical writing unit 80 for writing a latent image on the photosensitive drums 2Y, 2M, 2C, and 2K is disposed above the image forming units 1Y, 1M, 1C, and 1K. Based on image information received from external devices such as a personal computer (PC), the optical writing unit 80 illuminates the photosensitive drums 2Y, 2M, 2C, and 2K with a light beam projected from a light source such as a laser diode of the optical writing unit 80. Accordingly, the electrostatic latent images of yellow, magenta, cyan, and black are formed on the photosensitive drums 2Y, 2M, 2C, and 2K, respectively. More specifically, the potential of the portion of the uniformly-charged surface of the photosensitive drums 2 illuminated with the light beam is attenuated. The potential of the illuminated portion of the photosensitive drums 2 with the light beam is less than the potential of the other area, that is, a background portion (non-image formation area), thereby forming an electrostatic latent image on the surface of the photosensitive drums 2.

The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photosensitive drum 11. Alternatively, the optical writing unit 80 may employ a light source using an LED array including a plurality of LEDs that projects light.

Still referring to FIG. 1, a description is provided of the transfer unit 30. The transfer unit 30 is disposed below the image forming units 1Y, 1M, 1C, and 1K. The transfer unit 30 includes the intermediate transfer belt 31 serving as an image bearing member formed into an endless loop and entrained about a plurality of rollers, thereby rotating endlessly in the counterclockwise direction indicated by arrow A. The transfer unit 30 also includes a driving roller 32, a secondary-transfer back surface roller 33, a cleaning auxiliary roller 34, a nip forming roller 36, a belt cleaning device 37, a toner image detector 38, four primary transfer rollers 35Y, 35M, 35C, and 35K, and so forth.

The intermediate transfer belt 31 is entrained around and stretched taut between the driving roller 32, the secondary-transfer back surface roller 33, the cleaning auxiliary roller 34, and the primary transfer rollers 35Y, 35M, 35C, and 35K (hereinafter collectively referred to as the primary transfer rollers 35, unless otherwise specified). The driving roller 32 is rotated in the counterclockwise direction by a motor or the like, and rotation of the driving roller 32 enables the intermediate transfer belt 31 to rotate in the same direction.

The intermediate transfer belt 31 is made of resin such as polyimide resin in which carbon is dispersed and has a thickness in a range of from 20 μm to 200 μm, preferably, approximately 60 μm. The volume resistivity thereof is in a range of from 1e6 [Ωcm] to 1e12 [Ωcm], preferably, approximately 1e9 [Ωcm]. The volume resistivity is measured with an applied voltage of 100V by a high resistivity meter, Hiresta UPMCPHT 45 manufactured by Mitsubishi Chemical Corporation. The intermediate transfer belt 51 is made of resin such as polyimide resin in which carbon is dispersed.

The intermediate transfer belt 31 is a continuous belt formed into an endless loop and interposed between the photosensitive drums 2Y, 2M, 2C, and 2K, and the primary transfer rollers 35Y, 35M, 35C, and 35K. Accordingly, a primary transfer nip is formed between the front surface of the intermediate transfer belt 31 and the photosensitive drums 2Y, 2M, 2C, and 2K. The primary transfer rollers 35Y, 35M, 35C, and 35K are supplied with a primary bias by a transfer bias power source, thereby generating a transfer electric field between the toner images on the photosensitive drums 2Y, 2M, 2C, and 2K, and the primary transfer rollers 35Y, 35M, 35C, and 35K.

The toner image Y for yellow formed on the photosensitive drum 2Y enters the primary transfer nip as the photosensitive drum 2Y rotates. Subsequently, the toner image is transferred from the photosensitive drum 2Y to the intermediate transfer belt 31 by the transfer electrical field and the nip pressure. As the intermediate transfer belt 31 on which the toner image of yellow is transferred passes through the primary transfer nips of magenta, cyan, and black, accordingly, the toner images on the photosensitive drums 2M, 2C, and 2K are superimposed on the toner image of yellow, thereby forming a composite toner image on the intermediate transfer belt 31 in the primary transfer process.

Each of the primary transfer rollers 35 is constituted of an elastic roller including a metal cored bar on which a conductive sponge layer is provided. The outer diameter of the primary transfer roller 55 is approximately 16 mm. The diameter of the metal cored bar is approximately 10 mm. A resistance of the sponge layer is measured such that a metal roller having an outer diameter of 30 mm is pressed against the sponge layer at a load of 10N and a voltage of 1000V is supplied to the metal cored bar of the primary transfer roller 35. The resistance is obtained by Ohm's law R=V/I, where V is a voltage, I is a current, and R is a resistance. The obtained resistance R of the sponge layer is approximately 3E7Ω.

The primary transfer rollers 35Y, 35M, 35C, and 35K described above are supplied with a primary transfer bias under constant current control. According to the present illustrative embodiment, a roller-type primary transfer device is used as the primary transfer rollers 35Y, 35M, 35C, and 35K. Alternatively, a transfer charger and a brush-type transfer device may be employed as the primary transfer device.

The nip forming roller 36 of the transfer unit 30 is disposed outside the loop formed by the intermediate transfer belt 31, opposite the secondary-transfer back surface roller 33. The intermediate transfer belt 31 is interposed between the secondary-transfer back surface roller 33 and the nip forming roller 36, thereby forming a secondary transfer nip between the front surface or the image bearing surface of intermediate transfer belt 31 and the nip forming roller 36. According to the present illustrative embodiment, the nip forming roller 36 is grounded, and a secondary transfer bias is applied to the secondary-transfer back surface roller 33 by a secondary transfer bias power source 39. With this configuration, a secondary transfer electric field is formed between the secondary-transfer back surface roller 33 and the nip forming roller 36 so that the toner having negative polarity is transferred electrostatically from the secondary-transfer back surface roller 33 side to the nip forming roller 36 side.

As illustrated in FIG. 1, a sheet cassette 100 storing a stack of recording media sheets P is disposed below the transfer unit 30. The sheet cassette 100 is equipped with a sheet feed roller 100*a* to contact a top sheet of the stack of recording media sheets P. As the sheet feed roller 100*a* is rotated at a predetermined speed, the sheet feed roller 100*a* picks up the top sheet and feeds it to a sheet passage in the image forming apparatus. Substantially at the end of the sheet passage, the pair of registration rollers 101 is disposed. The pair of registration rollers 101 stops rotating temporarily as soon as the recording medium P is interposed therebetween. The pair of registration rollers 101 starts to rotate again to feed the recording medium P to the secondary transfer nip in appropriate timing such that the recording medium P is aligned with the composite toner image formed on the intermediate transfer belt 31 in the secondary transfer nip.

In the secondary transfer nip, the recording medium P tightly contacts the composite toner image on the intermediate transfer belt 31, and the composite toner image is transferred onto the recording medium P by the secondary transfer electric field and the nip pressure applied thereto. The recording medium P on which the composite color toner image is formed passes through the secondary transfer nip and separates from the nip forming roller 36 and the intermediate transfer belt 31.

The secondary-transfer back surface roller 33 is constituted of a metal cored bar made of, for example, stainless steel and aluminum on which a resistance layer is laminated. Specific preferred materials suitable for the resistance layer include, but are not limited to, polycarbonate, fluorine-based rubber, silicon rubber, and the like in which conductive particles such as carbon and metal complex are dispersed, or rubbers such as nitrile rubber (NBR) and Ethylene Propylene Diene Monomer (EPDM), rubber of NBR/ECO copolymer, and semiconductive rubber such as polyurethane. The volume resistivity of the resistance layer is in a range of from approximately $10^6$Ω to approximately $10^{12}$Ω, preferably in a range of from approximately $10^7$Ω to approximately $10^9$Ω.

The resistance layer may be a foam-type having the hardness in a range of from approximately 20 degrees to approximately 50 degrees or a rubber-type having a hardness in a range of from approximately 30 degrees to approximately 60 degrees. Because the secondary-transfer back surface roller 33 contacts the nip forming roller 36 via the intermediate transfer belt 31, the sponge-type layer is preferred because it reliably contacts the nip forming roller 36 via the intermediate transfer belt 31 even with a low contact pressure. Disturbance of the toner image such as toner dropouts and white spots occurs easily with a large contact pressure of the secondary-transfer back surface roller 33 relative to the intermediate transfer belt 31.

The nip forming roller 36 (a opposed roller) is constituted of a metal cored bar made of metal such as stainless steel and aluminum, and a resistance layer and a surface layer made of conductive rubber or the like disposed on the metal cored bar. According to the present illustrative embodiment, the external diameter of the nip forming roller 36 is approximately 20 mm, and the diameter of the metal cored bar is approximately 16 mm. The resistant layer is made of rubber of NBR/ECO copolymer having the hardness in the range of from 40 to 60 degrees according to JIS-A. JIS stands for Japanese Industrial Standards. The surface layer is made of fluorinated urethane elastomer. The thickness thereof is preferably in the range of from 8 to 24 μm. This is because the surface layer of the roller is generally formed through coating process, and if the thickness of the surface layer is 8 μm or less, the effect of uneven resistance due to uneven coating is significant. As a result, leakage may occur at a place with low resistance. Furthermore, the surface of the roller may wrinkle, causing cracks in the surface layer.

By contrast, when the thickness of the surface layer is 24 μm or more, the resistance becomes high. In a case in which the volume resistivity is high, the voltage may rise and exceed an allowable range of voltage change for the constant current power source when the constant current is supplied to the metal cored bar of the secondary-transfer back surface roller 33. As a result, the current may drop below the target value. In a case in which the allowable range of voltage change is high enough, the voltage of a high-voltage path from the constant current power source to the metal cored bar of the secondary-transfer back surface roller 33 and/or the metal cored bar of the secondary-transfer back surface roller 33 may become high, easily causing the leakage. When the thickness of the surface layer of the nip forming roller 36 is 24 μm or more, the hardness becomes high, thereby hindering the nip forming roller 36 from tightly contacting the recording medium P and the intermediate transfer belt 31. The surface resistivity of the nip forming roller 36 is equal to or greater than approximately $10^{6.5}\Omega$, and the volume resistivity of the surface layer is equal to or greater than approximately $10^{10}$ Ωcm, preferably approximately equal to or greater than $10^{12}$ Ωcm.

The toner image detector 38 is disposed outside the loop formed by the intermediate transfer belt 31, opposite the driving roller 32 which is grounded. More specifically, the toner image detector 38 faces a portion of the intermediate transfer belt 31 entrained around the driving roller 32 with a gap of approximately 5 mm. The toner image detector 38 may be an optical detector including one light emitting element and two light receiving elements which converts an output of the received light into an amount of adhered toner, thereby detecting an amount of toner adhered to the toner image primarily transferred onto the intermediate transfer belt 31.

On the right hand side of the secondary transfer nip between the secondary-transfer back surface roller 33 and the intermediate transfer belt 31, the fixing device 90 is disposed. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording medium P bearing an unfixed toner image on the surface thereof is delivered to the fixing device 90 and interposed between the fixing roller 91 and the pressing roller 92 in the fixing device 90. Under heat and pressure, the toner adhered to the toner image is softened and fixed to the recording medium P in the fixing nip. Subsequently, the recording medium P is discharged outside the image forming apparatus from the fixing device 90 via the sheet passage after fixing.

In the case of monochrome imaging, a support plate supporting the primary transfer rollers 35Y, 35M and 35C of the transfer unit 30 is moved to separate the primary transfer rollers 35Y, 35M, and 35C from the photosensitive drums 2Y, 2M, and 2C. With this configuration, the front surface of the intermediate transfer belt 31, that is, the image bearing surface, is separated from the photosensitive drums 2Y, 2M, and 2C so that the intermediate transfer belt 31 contacts only the photosensitive drum 2K for black color. In this state, only the image forming unit 1K is activated to form a toner image of black on the photosensitive drum 2K.

The secondary transfer bias power source 39 includes a direct current (DC) power source and an alternating current (AC) power source, and can output an AC voltage superimposed on a DC voltage as the secondary transfer bias. The output terminal of the secondary transfer bias power source 39 is connected to the metal cored bar of the secondary-transfer back surface roller 33. The potential of the metal cored bar of the secondary-transfer back surface roller 33 has almost the same value as the output voltage of the secondary transfer bias power source 39. Furthermore, the metal cored bar of the nip forming roller 36 is grounded.

According to the present illustrative embodiment, the nip forming roller 36 is grounded while the superimposed bias is applied to the metal cored bar of the secondary-transfer back surface roller 33. Alternatively, the secondary-transfer back surface roller 33 may be grounded while the superimposed bias is supplied to the metal cored bar of the nip forming roller 36. In this case, the polarity of the DC voltage is changed. More specifically, according to the present illustrative embodiment, in a case in which the superimposed bias is applied to the secondary-transfer back surface roller 33 while toner having negative polarity is used and the nip forming roller 36 is grounded, the DC voltage having the same negative polarity as the toner is used so that a time-averaged potential of the superimposed bias has the same negative polarity as the toner.

By contrast, when the secondary-transfer back surface roller 33 is grounded and the superimposed bias is applied to the nip forming roller 36, the DC voltage having positive polarity which is opposite that of the toner, is used so that the time-averaged potential of the superimposed bias is positive polarity opposite the polarity of toner. Instead of applying the superimposed bias to the secondary-transfer back surface roller 33 or the nip forming roller 36, the DC voltage may be supplied to one of the secondary-transfer back surface roller 33 and the nip forming roller 36, and the AC voltage may be supplied to the other rollers.

According to the present illustrative embodiment, the AC voltage having a sinusoidal waveform is used. Alternatively, an AC voltage having a non-sinusoidal wave may be used. When using a normal sheet of paper, such as the one having a relatively smooth surface, a pattern of dark and light according to the surface conditions of the sheet is less likely to appear on the resulting output image on the recording medium. In this case, the transfer bias consisting only of the DC voltage is supplied. By contrast, when using a recording medium having a rough surface such as pulp paper and embossed paper, the transfer bias needs to be changed from the transfer bias consisting only of the DC voltage to the superimposed bias.

After the intermediate transfer belt 31 passes through the secondary transfer nip, residual toner not having been transferred onto the recording medium remains on the intermediate transfer belt 31. The residual toner is removed from the intermediate transfer belt 31 by the belt cleaning device 37 which contacts the surface of the intermediate transfer belt 31. The cleaning auxiliary roller 34 disposed inside the loop formed by the intermediate transfer belt 31 supports the cleaning operation by the belt cleaning device 37 from inside the loop of the intermediate transfer belt 31 so that the residual toner on the intermediate transfer belt 31 is removed reliably.

Figure 3A:
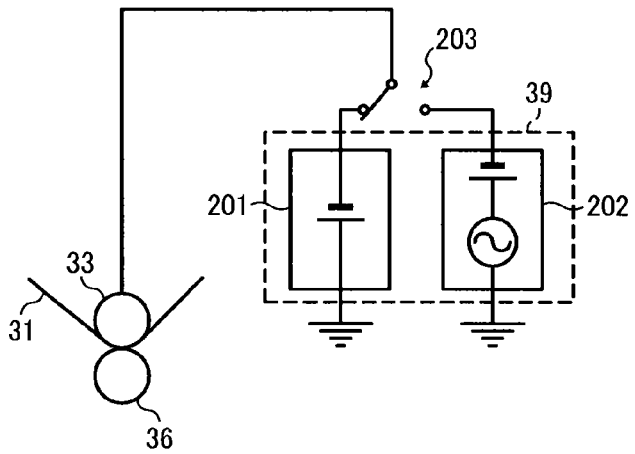
FIG. 3A is a schematic diagram illustrating a secondary transfer portion and a secondary transfer bias power source of the image forming apparatus when applying a direct current (DC) bias.
Figure 3B:
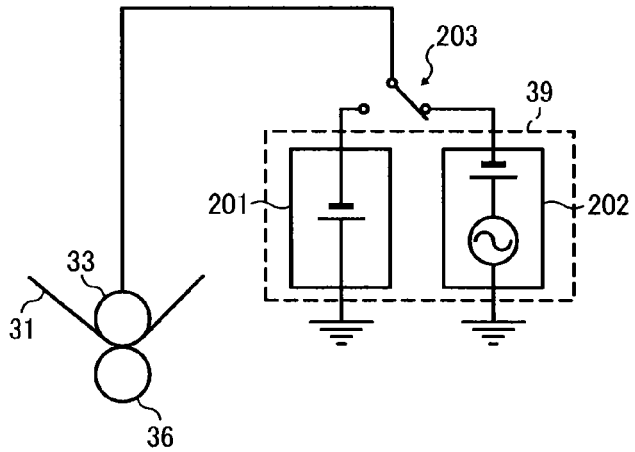
FIG. 3B is a schematic diagram illustrating the secondary transfer portion and the secondary transfer bias power source when applying a superimposed bias.

With reference to FIGS. 3A and 3B, a description is provided of changing the secondary transfer bias between the DC bias and the superimposed bias. FIG. 3A is a schematic diagram illustrating a configuration when applying a DC bias to the secondary transfer portion. FIG. 3B is a schematic diagram illustrating a configuration when applying a superimposed bias to the secondary transfer portion. In FIGS. 3A and 3B, the secondary transfer bias power source 39 includes a DC power source 201 and an AC-DC superimposed power source (hereinafter referred to as a superimposed bias power source) 202.

In FIG. 3A, a DC bias is applied to the secondary-transfer back surface roller 33 by the DC power source 201 by switching a switch 203. In FIG. 3B, a superimposed bias is applied to the secondary-transfer back surface roller 33 by the superimposed bias power source 202 by switching the switch 203. FIGS. 3A and 3B schematically illustrate switching the power source between the DC power source 201 and the superimposed bias power source 202 using the switch 203. As will be described later with reference to FIG. 5, two relays may be employed to switch the power source between the DC power source 201 and the superimposed bias power source 202.

The DC component bias output from the DC power source 201 is under constant current control. The DC component of the superimposed bias output from the superimposed bias power source 202 is under constant current control. The AC component of the superimposed bias output from the superimposed bias power source 202 is under constant voltage control.

Figure 4:
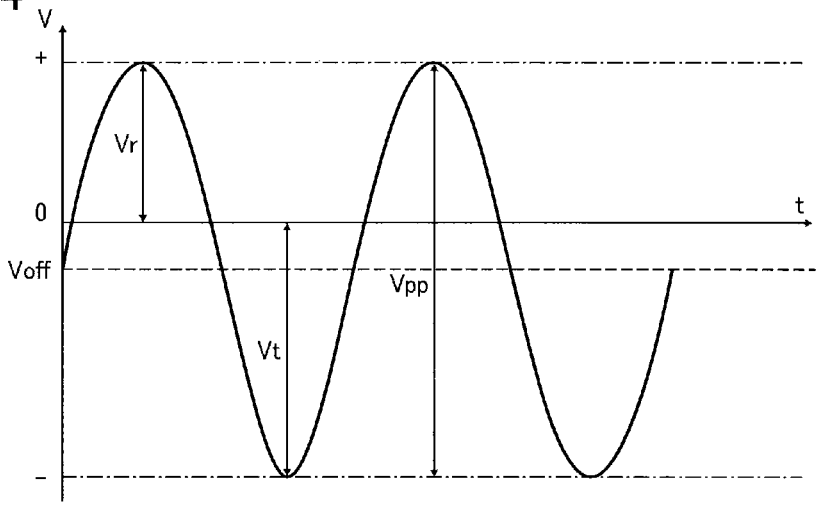
FIG. 4 illustrates a waveform of the superimposed bias output from the secondary transfer bias power source of the image forming apparatus.

With reference to FIG. 4, a description is provided of the secondary transfer bias output from the secondary transfer bias power source 39. FIG. 4 is a waveform chart showing a waveform of the secondary bias which is a superimposed bias output from the secondary transfer bias power source 39. As described above, the secondary transfer bias is supplied to the metal cored bar of the secondary-transfer back surface roller 33. The secondary transfer bias power source 39 serving as a voltage output device serves as a transfer bias application device that applies a transfer bias. When the secondary transfer bias is applied to the metal cored bar of the secondary-transfer back surface roller 33, a potential difference is generated between the metal cored bar of the secondary-transfer back surface roller 33 serving as a first transfer member and the metal cored bar of the nip forming roller 36 serving as a second transfer member. In other words, the secondary transfer bias power source 39 serves also as a potential difference generator.

In general, a potential difference is treated as an absolute value. However, in this specification, the potential difference is expressed with polarity. More specifically, a value obtained by subtracting a potential of the metal cored bar of the nip forming roller 36 from a potential of the metal cored bar of the secondary-transfer back surface roller 33 is considered as the potential difference. In a case in which the toner having negative polarity is used as in the illustrative embodiment, when the polarity becomes negative, the potential of the nip forming roller 36 is increased such that the potential of the nip forming roller 36 is greater than that of the secondary-transfer back surface roller 36 on the opposite polarity side to the polarity of charged toner (the positive side in the present embodiment). Accordingly, the toner is electrostatically moved from the secondary-transfer back surface roller side to the nip forming roller side.

In FIG. 4, an offset voltage Voff is a value of the DC component of the secondary transfer bias. A peak-to-peak voltage Vpp is an AC component of the peak-to-peak voltage of the secondary transfer bias. According to the present illustrative embodiment, the secondary transfer bias consists of a superimposed voltage in which the offset voltage Voff and the peak-to-peak voltage Vpp are superimposed. Thus, a time-averaged value of the superimposed bias coincides with the offset voltage Voff.

As described above, according to the present illustrative embodiment, the secondary transfer bias is applied to the metal cored bar of the secondary-transfer back surface roller 33 while the metal cored bar of the nip forming roller 36 is grounded (0V). Thus, the potential of the metal cored bar of the secondary-transfer back surface roller 33 becomes the potential difference between the potentials of the metal cored bar of the secondary-transfer back surface roller 33 and the metal cored bar of the nip forming roller 36. The potential difference between the potentials of the metal cored bar of the secondary-transfer back surface roller 33 and the metal cored bar of the nip forming roller 36 consists of a direct current component (Eoff) having the same value as the offset voltage Voff and an alternating current component (Epp) having the same value as the peak-to-peak voltage (Vpp).

According to the present illustrative embodiment, as illustrated in FIG. 4, the polarity of the offset voltage Voff is negative. When the polarity of the offset voltage Voff of the secondary transfer bias applied to the secondary-transfer back surface roller 33 is negative, the toner having negative polarity can be forced relatively from the secondary-transfer back surface roller side 33 to the nip forming roller 36 side. If the polarity of the secondary transfer bias is negative so is the polarity of the toner, the toner having negative polarity is forced electrostatically from the secondary-transfer back surface roller side 33 to the nip forming roller 36 side in the secondary transfer nip. Accordingly, the toner on the intermediate transfer belt 31 is transferred onto the recording medium P.

By contrast, if the polarity of the secondary transfer bias is opposite that of the toner, that is, the polarity of the secondary transfer bias is positive, the toner of negative polarity is attracted electrostatically to the secondary-transfer back surface roller 33 side from the nip forming roller 36 side. Consequently, the toner transferred to the recording medium P is attracted again to the intermediate transfer belt 31. It is to be noted that because the time-averaged value of the secondary transfer bias (the same value as the offset voltage Voff in the present illustrative embodiment) has negative polarity, the toner is pushed electrostatically from the secondary-transfer back surface roller side to the nip forming roller side. In FIG. 4, a return peak potential Vr represents a positive peak value having the polarity opposite that of the toner.

When using a recording medium having a coarse surface such as a textured sheet, an embossed sheet, and a Japanese sheet having a high degree of surface roughness, it is known that application of the superimposed bias can move the toner from the belt side to the recording medium relatively while moving the toner back and forth. With this configuration, the transferability of the toner relative to the recessed portions on the recording medium is enhanced, thus preventing image defects such as dropouts and blank spots. By contrast, when using a normal recording medium having a relatively smooth surface, application of a secondary transfer bias including only a DC component can achieve sufficient transferability of toner.

According to the present illustrative embodiment, as described above, the image forming apparatus includes a direct-current (DC) transfer mode and a superimposed-bias transfer mode. In the DC transfer mode, a DC bias is applied as a secondary transfer bias to transfer secondarily an image onto a recording medium. In the superimposed-bias transfer mode, a superimposed bias including an AC component superimposed on a DC component is applied to transfer secondarily an image onto a recording medium. The DC transfer mode and the superimposed-bias transfer mode are switchable by the switch and relays. Depending on the type of the recording medium, the transfer mode can be switched between the DC transfer mode and the superimposed-bias transfer mode, thereby transferring adequately the toner onto a recording medium regardless of the surface conditions of the recording medium. The transfer mode may be switched automatically in accordance with the types of recording media. Alternatively, a user may choose the transfer mode. In either case, the transfer mode may be set using a control panel (a display device 304 illustrated in FIG. 5) of the image forming apparatus.

Figure 5:
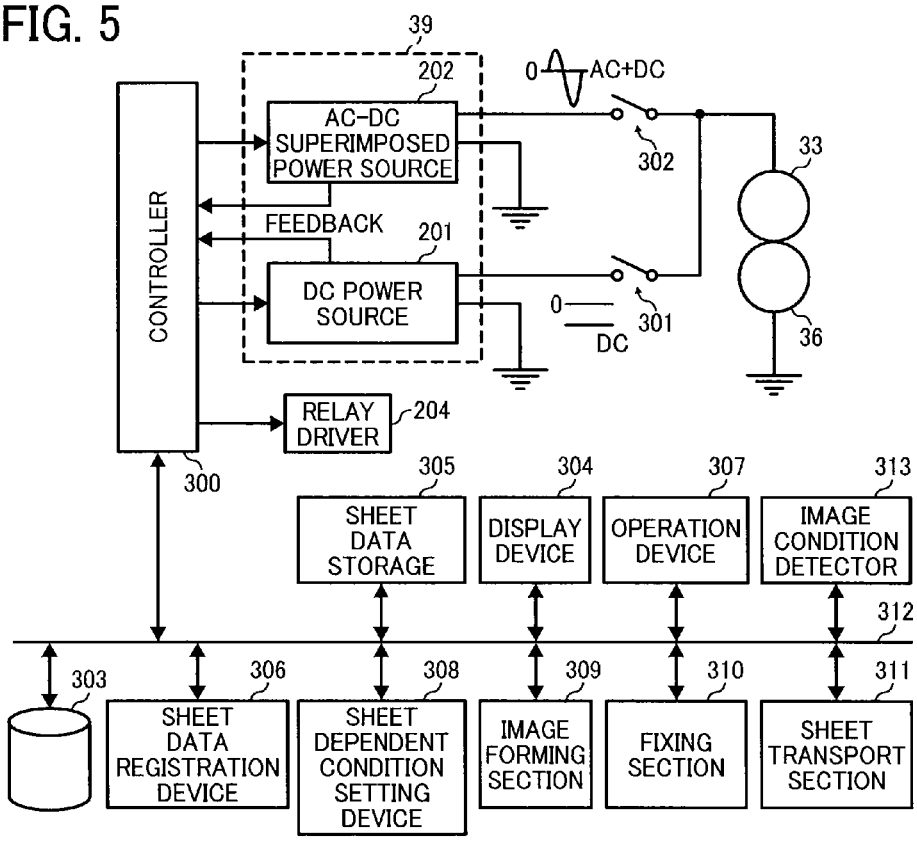
FIG. 5 is a block diagram illustrating application of a secondary transfer bias.

With reference to FIG. 5, a description is provided application of the secondary transfer bias. FIG. 5 is a block diagram showing the secondary transfer power source 39 and a controller 300. According to the present illustrative embodiment, two relays are used to switch between the power sources to apply the bias. As illustrated in FIG. 5, the DC power source 201 applies a DC bias to the secondary-transfer back surface roller 33 via a relay 301. The superimposed bias power source 202 applies a superimposed bias to the secondary-transfer back surface roller 33 via a relay 302. The controller 300 connects and disconnects the two relays, that is, the relay 301 and the relay 302 via a relay driver 204. Accordingly, the secondary transfer bias is switched between the DC bias and the superimposed bias. A feedback voltage is provided to the controller 300 by the DC power source 201 and the superimposed bias power source 202.

According to the present illustrative embodiment, in the DC transfer mode in which the DC bias is applied as the secondary transfer bias to transfer the toner image, based on the feedback voltage from the DC power source 201, a resistance at the secondary transfer nip (a resistance including the intermediate transfer belt 31 and the recording medium) is calculated to determine the transfer current.

Figure 6:
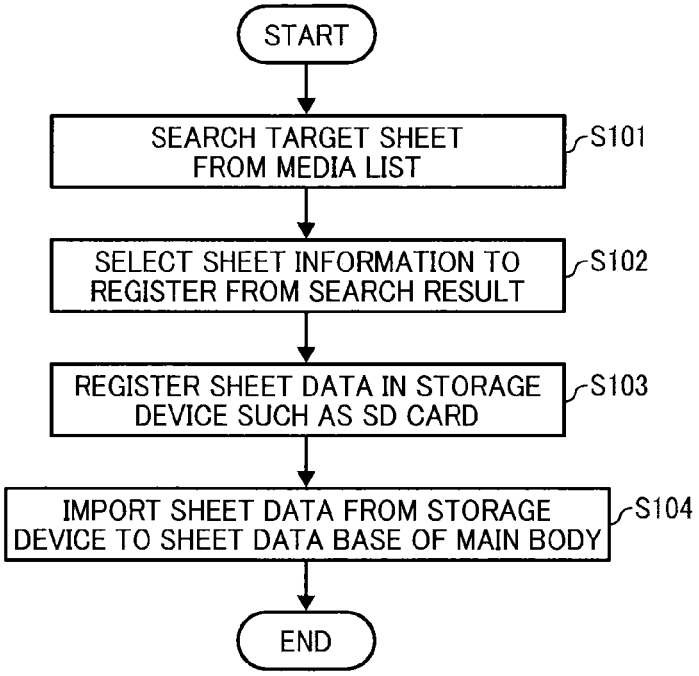
FIG. 6 is a flowchart showing example steps in a process of registration of sheet information in a sheet database provided to the image forming apparatus.

With reference to FIG. 6, a description is provided of a registration and editing method of a user sheet. FIG. 6 is a flowchart showing example steps in a process of registration and editing of the user sheet. According to the present illustrative embodiment, a desired sheet can be registered as a user sheet and edited using the control panel or the display device 304 illustrated in FIG. 5. Alternatively, the user sheet can be registered and edited remotely by using a computer such as a PC, and network.

First, sheet information such as a publicly-known name of a sheet and sheet data including sheet dependent conditions is registered in a form of a list in a sheet database (hereinafter referred to as sheet DB) 303 provided to the image forming apparatus. It is to be noted that the sheet dependent conditions herein refer to parameters including, but not limited to, a DC component voltage, an AC component voltage, a fixing temperature, and a sheet conveyance speed, that depend on the conditions of the sheet.

At Step S101, a target sheet is searched from a sheet information list (also known as MediaList) released to the public. Domestic and overseas users can obtain the sheet information list or the MediaList from a manufacturer's homepage, or the manufacturer provides users with the sheet information list.

At Step S102, the sheet information of the target sheet that the user wishes to register is selected from a search result shown on the display device 304. Subsequently, the selected sheet information is saved or registered as sheet data for the target sheet to be set in a memory device such as an SD card (i.e., a sheet data storage 305) by a sheet data registration device 306.

At Steps S103 and S104, the sheet information is imported to the sheet DB 303. More specifically, at Steps S102, S103, and S104, after the user selects the sheet information, the user informs the manufacturer, and the manufacturer imports the sheet information to the sheet DB 303. Alternatively, the user selects and downloads the sheet information from the sheet information list obtained from the homepage of the manufacturer. Then, the sheet information is imported to the sheet DB 303. Subsequently, the sheet dependent conditions contained in the selected sheet information are edited and set, and then the sheet information including new sheet dependent conditions is saved/registered as a user sheet in the sheet data storage 305 such as the SD card by the sheet data registration device 306. With this configuration, when the user sheet once saved/registered is used again, the sheet dependent conditions included in the sheet information for the subject user sheet can be used without any modification so that the sheet dependent conditions do not need to be set again.

Figure 7:
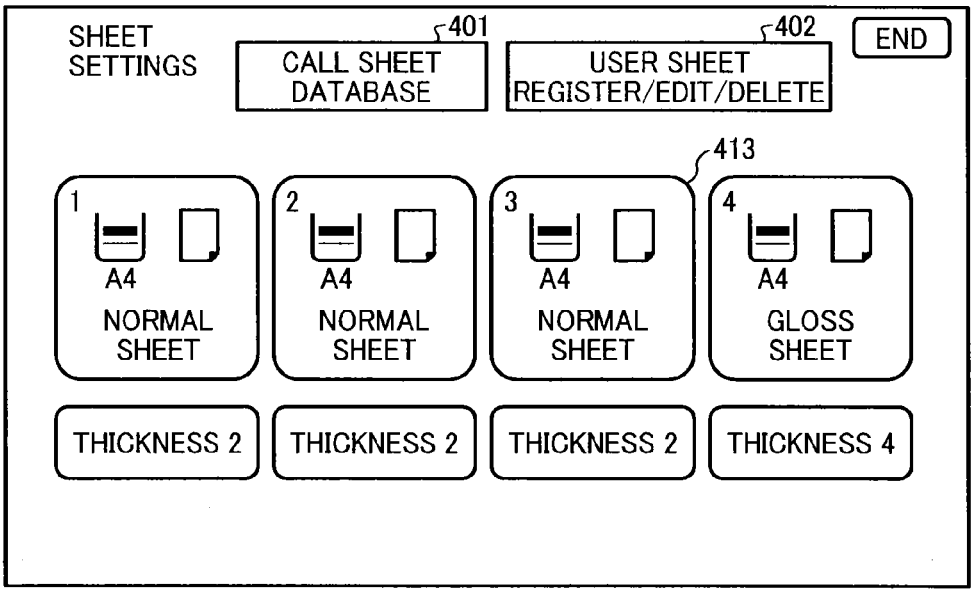
FIG. 7 is a schematic diagram illustrating a dialog box for sheet settings.

Next, a description is provided of registration of the user sheet. A sheet setting button (i.e., an operation device 307 of FIG. 5) provided to the control panel (i.e., the display device 304 of FIG. 5) is pressed so that a sheet setting dialog box is shown as illustrated in FIG. 7. As illustrated in FIG. 7, in the sheet setting dialog box, trays 1 through 3 store recording media sheets of a category of normal paper and having a thickness categorized as thickness 2 of a thickness group. Tray 4 stores recording media sheets of a category of gloss paper and having a thickness categorized as thickness 4. TABLE 1 shows the thickness group. TABLE 2 shows the sheet category.

TABLE 1

| | SHEET BASIS WEIGHT (gsm) |
|---|---|
| THICKNESS 1 | 52.3~63.0 |
| THICKNESS 2 | 63.1~80.0 |
| THICKNESS 3 | 80.1~105.0 |
| THICKNESS 4 | 105.1~163.0 |
| THICKNESS 5 | 163.1~220.0 |
| THICKNESS 6 | 220.1~256.0 |
| THICKNESS 7 | 256.1~300.0 |

TABLE 2

| SHEET CATEGORY |
|---|
| NORMAL PAPER |
| GLOSS PAPER |
| MATTE PAPER |
| ENVELOPE |
| OHP |

In order to register the sheet information imported to the sheet DB in the process illustrated in FIG. 6 as a user sheet, a "CALL SHEET DATABASE" button 401 (i.e., the operation device 307) for calling sheet database illustrated in FIG. 7 is pressed to continue to the next dialog box. Subsequently, a "CALL SHEET DATABASE" dialog box (i.e., the display device 304) which shows the imported sheet information as illustrated in FIG. 8. For the textured sheet, the transfer mode can be selected from the DC transfer mode and the superimposed-bias transfer mode. For example, according to the present illustrative embodiment shown in FIG. 8, the transfer mode includes the superimposed-bias transfer mode (002) for the textured sheet "LEATHAC 66 (registered trademark) 100 kg (116 gsm) Special Sheet" and the DC transfer mode (003) for the textured sheet "LEATHAC 66 (registered trademark) 100 kg (116 gsm) Special Sheet".

The sheet to be registered as the user sheet is selected using the control panel (i.e., the operation device 307). According to the present illustrative embodiment, "002 LEATHAC 66 100 kg (116 gsm) SPECIAL SHEET (SUPERIMPOSED-BIAS TRANSFER MODE)" is selected, for example. Accordingly, "LEATHAC 66 100 kg (116 gsm) SPECIAL SHEET (SUPERIMPOSED-BIAS TRANSFER MODE)" is registered as the user sheet 001. Subsequently, the dialog box returns to the "SHEET SETTINGS" illustrated in FIG. 7.

Next, a description is provided of editing of sheet dependent conditions for the user sheet.

Figure 9:
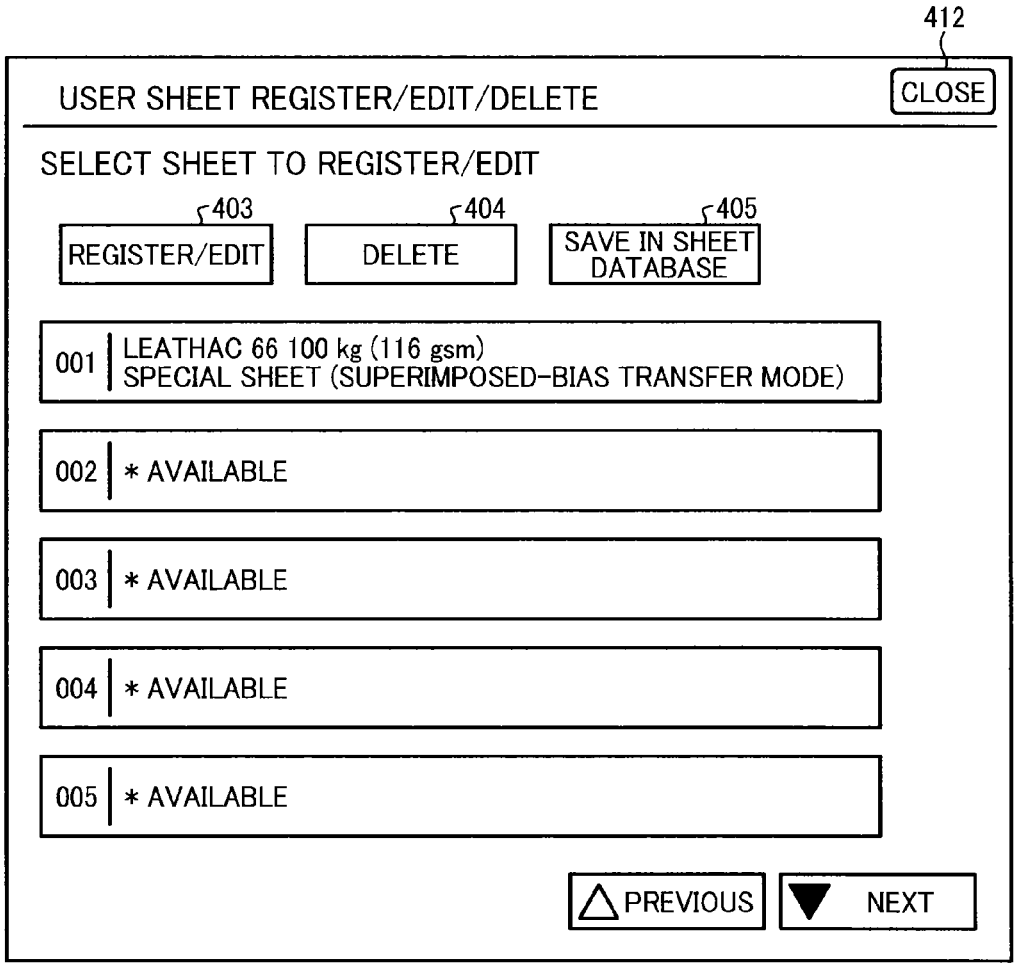
FIG. 9 is a schematic diagram illustrating a dialog box for registration/editing/deletion of a user sheet.

When changing the conditions, as illustrated in FIG. 7, a button 402 (i.e., the operation device 307 of FIG. 5) showing "USER SHEET REGISTER/EDIT/DELETE" is pressed to continue to the next dialog box. Subsequently, as illustrated in FIG. 9, a dialog box "USER SHEET REGISTER/EDIT/DELETE" for allowing the user to register, edit, and delete the user sheet is shown. As illustrated in FIG. 9, the user can confirm that the sheet "LEATHAC 66 100 kg (116 gsm) SPECIAL SHEET (SUPERIMPOSED-BIAS TRANSFER MODE)" has been set as the user sheet 001.

Figure 10:
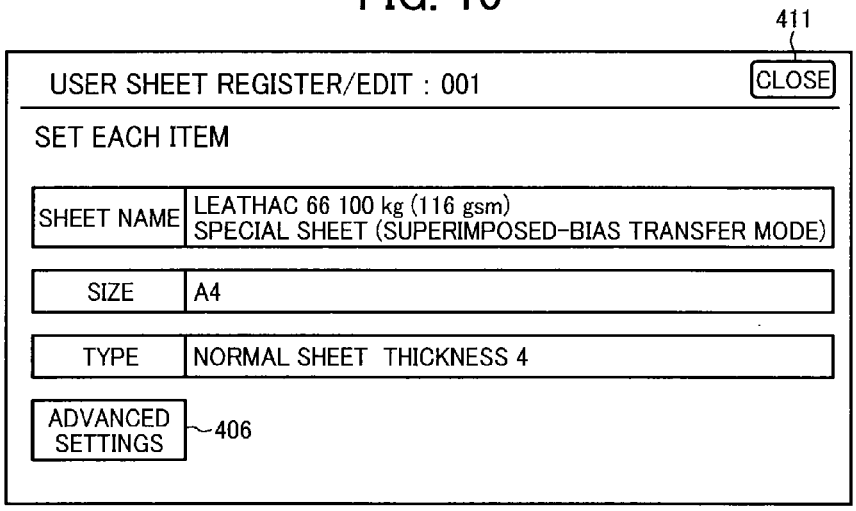
FIG. 10 is a schematic diagram illustrating a dialog box for registration/editing of the user sheet.

When editing the conditions, as illustrated in FIG. 9, first, a button 403 (i.e., the operation device 307) showing "REGISTER/EDIT" for registration and editing is pressed. After pressing the button 403, the user sheet to be edited is selected. According to the present illustrative embodiment, the user sheet No. 001 is selected, and then the next dialog box is shown as illustrated in FIG. 10. When deleting the user sheet or registering the sheet information in the sheet DB, a button 404 (i.e., the operation device 307) showing "DELETE" for deleting, located next to the button 403, or a button 405 (i.e., the operation device 307) showing "SAVE IN SHEET DB" for saving in the sheet database is pressed and then the target user sheet is selected.

As illustrated in FIG. 10, various items such as the name, size, and type of the sheet, and advanced settings can be edited in the dialog box "USER SHEET REGISTER/EDIT". In the present example, in order to change the advanced settings of the user sheet No. 001, a button 406 (i.e., the operation device 307 of FIG. 5) showing "ADVANCED SETTINGS" as illustrated in FIG. 10 is pressed to continue to the next dialog box shown in FIG. 11. Subsequently, a dialog box for the advanced settings is shown as illustrated in FIG. 11.

Figure 11:
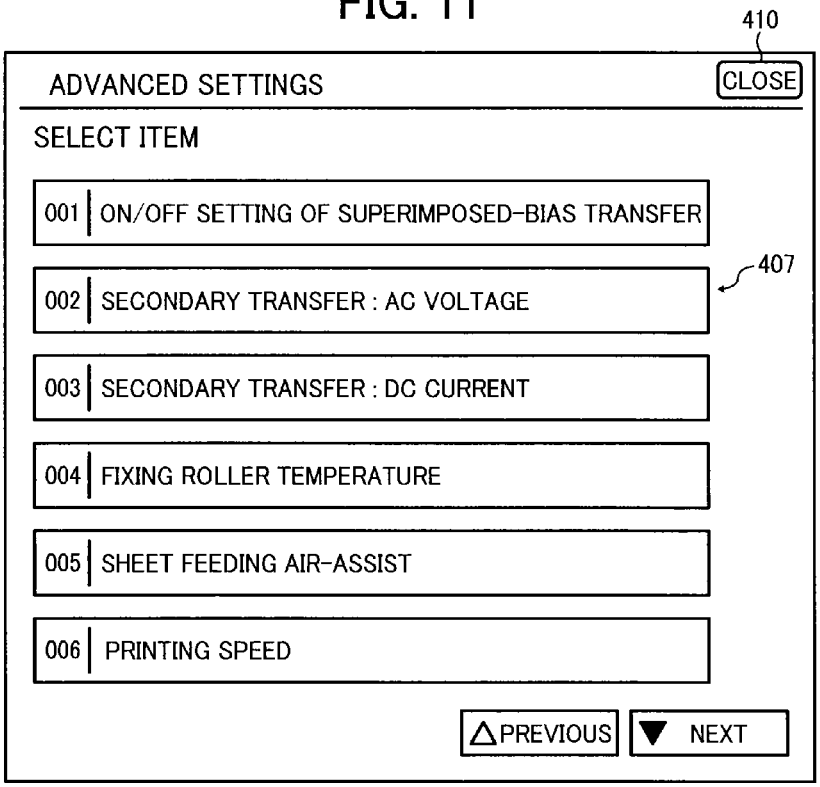
FIG. 11 is a schematic diagram illustrating a dialog box for advanced settings.

In FIG. 11, the sheet dependent conditions for "LEATHAC 66 100 kg (116 gsm) SPECIAL SHEET (SUPERIMPOSED-BIAS TRANSFER MODE)" are shown. As illustrated in FIG. 11, various sheet dependent conditions are shown in the dialog box. The sheet dependent conditions include, but are not limited to, the transfer conditions including "SUPERIMPOSED-BIAS TRANSFER ON/OFF SETTING", "SECONDARY TRANSFER: AC VOLTAGE", and "SECONDARY TRANSFER: DC CURRENT", "FIXING ROLLER TEMPERATURE" for the fixing condition, "SHEET FEEDING AIR-ASSIST SETTING" for transportation of the sheet, and "PRINTING SPEED SETTING" for the printing speed. The transfer conditions illustrated in FIG. 11 are adjustable by the user because the transfer conditions influence transferability of toner relative to the recessed portions and projecting portions of the surface of the sheet. More specifically, "SUPERIMPOSED-BIAS TRANSFER ON/OFF SETTING" allows the user to choose whether to perform printing in the superimposed-bias transfer mode, and is the only item that can be set for the user sheet. When "SUPERIMPOSED-BIAS TRANSFER ON/OFF SETTING" is on, transfer of a toner image is performed at the superimposed-bias transfer mode. When "SUPERIMPOSED-BIAS TRANSFER ON/OFF SETTING" is off, the DC transfer mode is carried out.

The fixing condition is also adjustable by the user, because the optimum fixing condition is different depending on the thickness of the sheet and so forth. Furthermore, the sheet transport condition is also adjustable by the user, because the optimum condition thereof is different depending on the thickness and type of the sheet (e.g., a normal sheet as compared with a gloss sheet).

Furthermore, when "SECONDARY TRANSFER: AC VOLTAGE" is elected, the user can adjust the AC component value of the transfer bias per unit of voltage. When "SECONDARY TRANSFER: DC CURRENT" is selected, the user can adjust the DC component value of the transfer bias per unit of current.

According to the present illustrative embodiment, the conditions for the sheet "LEATHAC 66 100 kg (116 gsm) SPECIAL SHEET (SUPERIMPOSED-BIAS TRANSFER MODE)" are as follows.

"SUPERIMPOSED-BIAS TRANSFER ON/OFF SETTING": ON

"SECONDARY TRANSFER (AC VOLTAGE)": 5 kV

"SECONDARY TRANSFER (DC CURRENT)": −56 μA

"FIXING ROLLER TEMPERATURE": 175° C.

"SHEET FEEDING AIR-ASSIST SETTING": OFF

"PRINTING SPEED SETTING": SLOW

Next, a description is provided of editing advanced settings. In the present example, a description is provided of changing one of the transfer conditions, that is, "SECONDARY TRANSFER: AC VOLTAGE" as an example.

Figure 12:
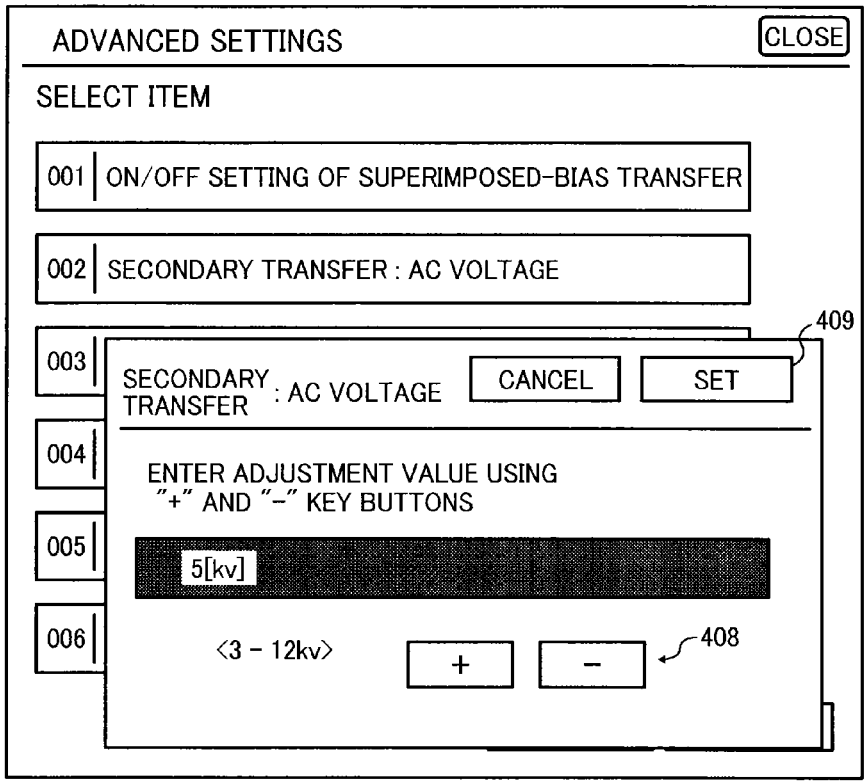
FIG. 12 is a schematic diagram illustrating a dialog box for changing the advanced settings.

As illustrated in FIG. 11, a button 407 (i.e., the operation device 307 of FIG. 5) showing "002 SECONDARY TRANSFER: AC VOLTAGE" is pressed to continue to the next dialog box for editing illustrated in FIG. 12. In FIG. 12, the current setting value (5 kV) is shown in the dialog box. A button 408 (i.e., the operation device 307 of FIG. 5) of "+" or "−" is pressed to change the setting value. A button 409 (i.e., the operation device 307 of FIG. 5) showing "SET" is pressed to fix the change, returning to the dialog box as illustrated in FIG. 11. In a case in which other changes are made continuously, the target item is selected and changed through the dialog box for editing.

According to the present illustrative embodiment, it is assumed that the users enter numerical values. Alternatively, in the printing speed settings, for example, stepwise modifications such as "SLOW", "MEDIUM", and "FAST" may be made. In stead of using the buttons shown in the screen, the users may use a numeric keypad attached to the image forming apparatus to enter the numerical values.

According to the present illustrative embodiment, the sheet data includes the sheet information containing preset sheet dependent conditions, and such sheet data is registered as the user sheet. Alternatively, users may register arbitrarily a user sheet. In this case, the button 402 in the dialog box "SHEET SETTINGS" illustrated in FIG. 7 is pressed to continue to the next dialog box "USER SHEET REGISTER/EDIT/DELETE" illustrated in FIG. 9. Subsequently, as illustrated in FIG. 9, a button "AVAILABLE" is selected to continue to the next dialog box "USER SHEET REGISTER/EDIT" in which the user can register and edit the user sheet.

Figure 13:
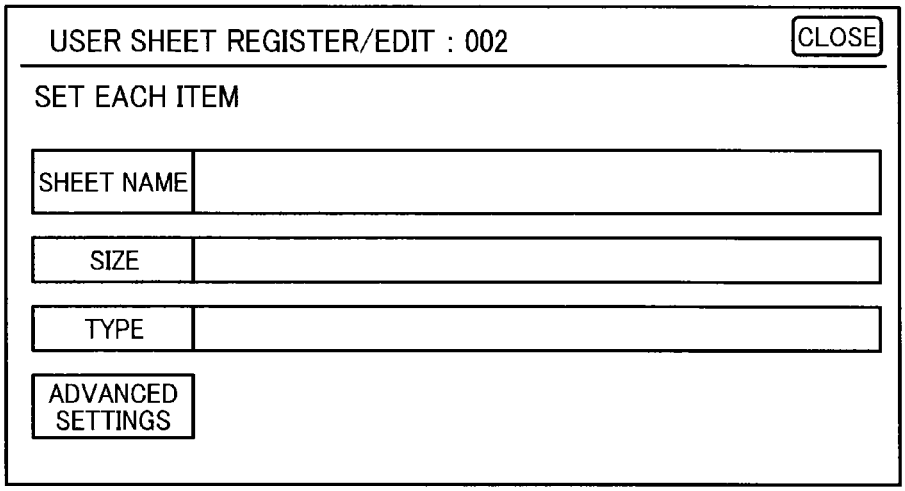
FIG. 13 is a schematic diagram illustrating a dialog box for registration/editing of a new user sheet which has not been registered.

In the present example, when a button "002 AVAILABLE" shown in FIG. 9 is selected, the dialog box "USER SHEET REGISTER/EDIT: 002" illustrated in FIG. 13 is shown, allowing the user to register and edit the user sheet (No. 002). Unlike the dialog box shown in FIG. 10, items such as the name, size, and type of the sheet shown in FIG. 13 are blank. Here, the user can enter values. Additionally, the advanced settings can be set as described above.

Figure 14:
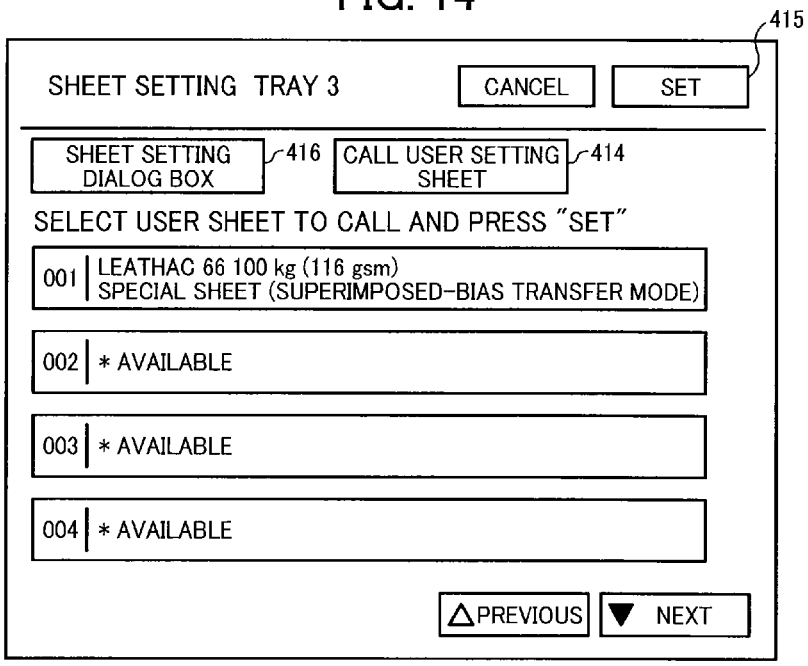
FIG. 14 is a schematic diagram illustrating a dialog box for associating a tray with the user sheet.
Figure 15:
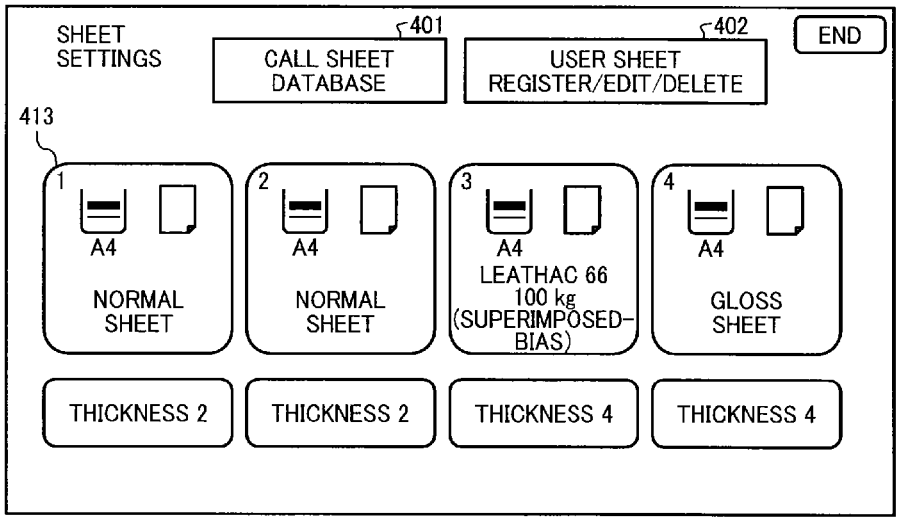
FIG. 15 is a schematic diagram illustrating a dialog box after associating the tray with the user sheet.

Lastly, a sheet tray is associated with the user sheet. "CLOSE" buttons 410 shown in FIG. 11, 411 shown in FIG. 10, 412 shown in FIG. 9 are pressed to return to the "SHEET SETTINGS" dialog box shown in FIG. 7. In the "SHEET SETTINGS" dialog box, a desired tray for storing the user sheets is selected. In the present example, a tray 3 is selected. In other words, a button 413 for the tray 3 is pressed to continue to the next dialog box "SHEET SETTINGS TRAY 3" illustrated in FIG. 14. FIG. 14 illustrates the dialog box when a button 414 showing "CALL USER SHEET" is pressed. Here, "LEATHAC66 100 kg (116 gsm) SPECIAL SHEET (SUPERIMPOSED-BIAS TRANSFER MODE)" is selected, and a "SET" button 415 is pressed. Accordingly, the tray 3 is associated with the user sheet No. 001, and then the dialog box illustrated in FIG. 15 is shown. As illustrated in FIG. 15, "LEATHAC66 (SUPERIMPOSED) 100 kg" is shown under the tray 3. In this state, when the tray 3 is selected and printing is started, printing is performed using the sheet dependent conditions that have been set. When pressing a "SHEET SETTINGS" button 416 in a state illustrated in FIG. 14, the user sheet is not used and the thickness and sheet type are selected.

According to the present illustrative embodiment, users set the sheet dependent conditions in each setting dialog box shown on the control panel. Alternatively, as illustrated in FIG. 5, an image condition detector 313 is provided to detect optically imaging defects such as toner dropouts in a resulting image on the sheet. In accordance with a detection result, the sheet dependent conditions may be optimized automatically and set.

Various setting items are not limited to the items described above. The number of trays to be set may be increased or reduced depending on peripheral devices attached to the image forming apparatus. Furthermore, the thickness groups and sheet types may be further divided into more detail groups. As for the sheet dependent conditions, as described above, various sheet dependent conditions such as the primary transfer current setting, the fixing speed, the sheet output speed, and the printing mode can be individually set or changed using a sheet dependent condition setting device 308. Adjustment values for the sheet dependent conditions that have been set or changed are registered in an image forming portion 309, an fixing portion 310, and a sheet transport portion 311 illustrated in FIG. 5. Each of the conditions is sent to the controller 300 through an internal bus 312, thereby controlling the secondary transfer bias power source 39, the relay driver 204, the fixing device 90, and a sheet conveyance device.

Next, a description is provided of an effect of an Embodiment 1 in which image printing is performed using the sheet "LEATHAC 66 100 kg (116 gsm) SPECIAL SHEET (SUPERIMPOSED-BIAS TRANSFER MODE)" set as the user sheet No. 001 as compared with Comparative Examples 1 and 2. Present inventors performed experiments to evaluate image defects.

Comparative Example 1

In the Comparative Example 1, gloss paper of a thickness group 4 was assigned to a tray 4.

Comparative Example 2

In the Comparative Example 2, normal paper of a thickness group 3 was registered as the user sheet. In the advanced settings, the printing speed was set "slow", and the fixing roller temperature was changed to 180° C. (DC transfer mode).

TABLE 3 shows setting conditions for the Embodiment 1, and the Comparative Examples 1 and 2. Each setting value for the Embodiment 1 and the Comparative Example 2 was changed through the advanced settings described above.

TABLE 3

| ADJUSTMENT ITEMS | EMBODIMENT 1 | COMPARATIVE EXAMPLE 1 | COMPARATIVE EXAMPLE 2 |
|---|---|---|---|
| PRINTING SPEED | SLOW | NORMAL | SLOW |
| SUPERIMPOSED TRANSFER ON/OFF | ON | OFF | OFF |
| SECONDARY TRANSFER: AC VOLTAGE | 5 kVpp | — | — |
| SECONDARY TRANSFER DC CURRENT (μA) | −56 | −70 | −70 |
| FIXING ROLLER TEMPERATURE (° C.) | 175 | 170 | 180 |
| SHEET FEEDING AIR ASSIST | OFF | ON | OFF |

Figure 16:
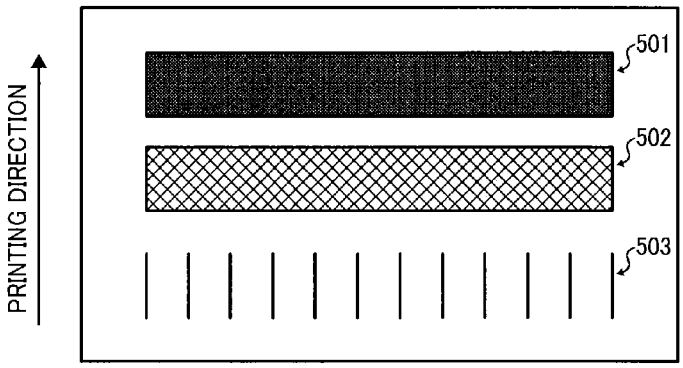
FIG. 16 is a schematic diagram illustrating a test image including a solid image, a halftone image, and a line image for an experiment.

In the Comparative Example 1, the sheet was not the user sheet. Thus, the default setting values were applied and were not adjustable. LEATHAC 66 having a ream weight of 100 kg (Thickness 4, textured paper) and POD gloss coat paper 128 gsm (Thickness 4, gloss paper) manufactured by Oji Paper Co., Ltd. were used. A chart consisting of solid image (blue) 501, a halftone image (cyan) 502, and a line image (blue) 503 as illustrated in FIG. 16 was formed on the above paper under the temperature 23° C., 50% humidity, and the resulting image was examined.

TABLE 4

| PAPER | IMAGE | EMBODIMENT 1 | COMPARATIVE EXAMPLE 1 | COMPARATIVE EXAMPLE 2 |
|---|---|---|---|---|
| LEATHAC 66 | 501 | GOOD | POOR | POOR |
| 100 kg (116 gsm) | 502 | GOOD | POOR | POOR |
| | 503 | GOOD | POOR | POOR |
| POD GLOSS | 501 | GOOD | GOOD | POOR |
| COAT 128 gsm | 502 | POOR | GOOD | POOR |
| | 503 | POOR | GOOD | POOR |

In TABLE 4, GOOD indicates that the resulting image had no image defect. POOR indicates that the resulting image had image defect(s). As shown in TABLE 4, in the Embodiment 1, when using LEATHAC 66 100 kg, no image defect was generated. By contrast, in the Comparative Example 1, toner was transferred inadequately to the recessed portions of the sheet, resulting in dropouts of toner. In the Comparative Example 2, in addition to dropouts of toner at the recessed portions, image peeling was generated due to a high fixing temperature.

As for POD gloss coat paper 128 gsm, in the Comparative Example 1, no image defect was generated. By contrast, in the Embodiment 1, scattering of toner was observed in the halftone image 501 and the line image 503 scattered. In the Comparative Example 2, image peeling was generated due to the high fixing temperature. As described above, it was confirmed that toner was transferred adequately to the textured paper when the textured paper was registered as the user sheet (superimposed-bias transfer mode), and it was necessary to form an image with proper conditions for different types of sheets.

Figure 17:
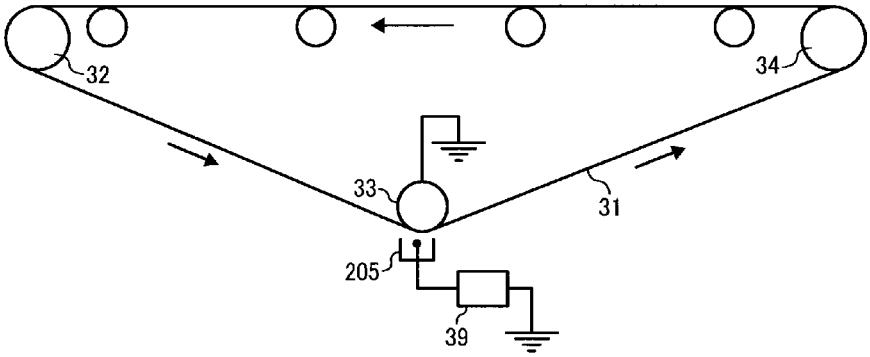
FIG. 17 is a schematic diagram illustrating an image forming apparatus using a transfer charger as a secondary transfer device according to another illustrative embodiment of the present invention.

With reference to FIG. 17, a description is provided of a charger serving as a contact-free transfer device according to a second illustrative embodiment. As illustrated in FIG. 17, a transfer charger 205 serving as a contact-free transfer device is disposed opposite the secondary-transfer back surface roller 33 contacting the back surface of the intermediate transfer belt 31. The secondary transfer bias power source 39 applies switchably the DC bias and the superimposed bias as the secondary transfer bias to the transfer charger 205.

As a secondary transfer bias power source, the secondary transfer bias power source 39 of the foregoing embodiments can be employed. According to the second illustrative embodiment, the polarity of the DC component of the transfer bias applied to the transfer charger 205 is the polarity opposite that of the toner. The toner image on the intermediate transfer belt 31 is transferred onto the recording medium delivered between the secondary-transfer back surface roller 33 and the transfer charger 205 via the intermediate transfer belt 31, by absorbing the toner image to the recording medium.

According to the second illustrative embodiment, similar to the foregoing illustrative embodiments, the transfer mode of the secondary transfer portion is changed while the output of the DC power source 201 and the AC power source (superimposed bias power source) 202 are turned off. With this configuration, the current is prevented from flowing backward from the DC power source 201 to the AC power source 202 or from the AC power source 202 to the DC power source 201, thereby preventing the power source from getting damaged. Because the current is prevented from flowing backward to the power source, it is not necessary to increase the withstand voltage of the power source, preventing the cost of the power source from increasing.

Figure 18:
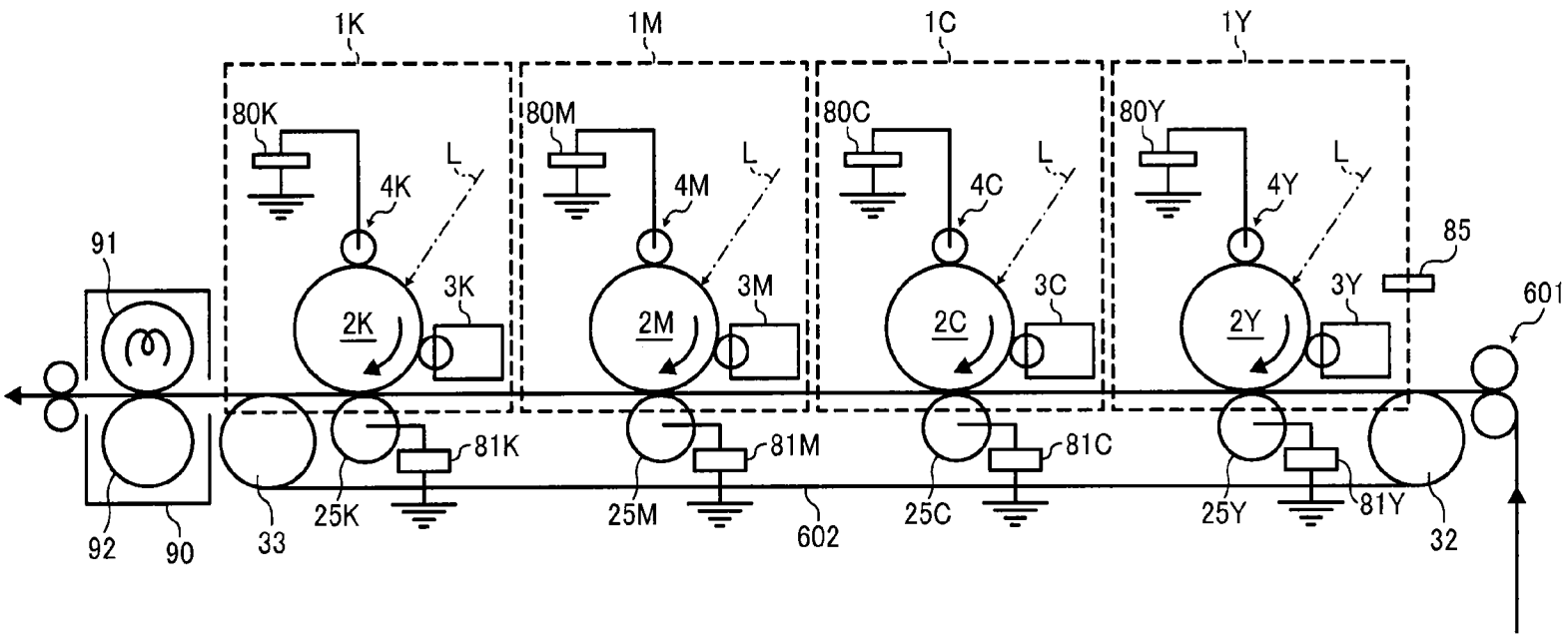
FIG. 18 is a cross-sectional diagram schematically illustrating a color printer using a direct transfer method as an example of an image forming apparatus according to an illustrative embodiment of the invention.

According to the illustrative embodiments described above, the image forming apparatus employs the intermediate transfer method in which the toner image formed on the photosensitive member is transferred primarily onto the intermediate transfer belt, and then transferred onto a recording medium. Alternatively, the image forming apparatus may employ a direct transfer method in which the toner image formed on the photosensitive member is transferred directly onto a recording medium as illustrated in FIG. 18. FIG. 18 is a cross-sectional diagram schematically illustrating an image forming apparatus of the direct transfer method.

In the image forming apparatus of the direct transfer method as illustrated in FIG. 18, the recording medium is fed onto a conveyance belt 602 by a pair of registration rollers 601, and the toner images on photosensitive drums 2Y, 2C, 2M, and 2K are transferred directly onto the recording medium by transfer rollers 25Y, 25C, 25M, and 25K, respectively, such that they are superimposed one atop the other, thereby forming a composite toner image on the recording medium. Subsequently, the composite toner image is fixed by the fixing device 90. The conveyance belt 131 is formed into a loop and entrained about the support rollers 32 and 33. Each of power sources 81Y, 81C, 81M, and 81K includes two power sources: a DC power source and an AC power source. The DC power source applies a DC bias. The AC power source applies an AC bias (AC-DC superimposed bias). The power sources 81Y, 81C, 81M, and 81K can switch the transfer bias between the DC bias and the superimposed bias. According to the present illustrative embodiment, similar to the foregoing illustrative embodiments, the transfer mode is changed while the output of the DC power source and the AC power source (superimposed bias power source) is turned off. The same effect as that of the foregoing embodiments can be achieved.

Figure 19:
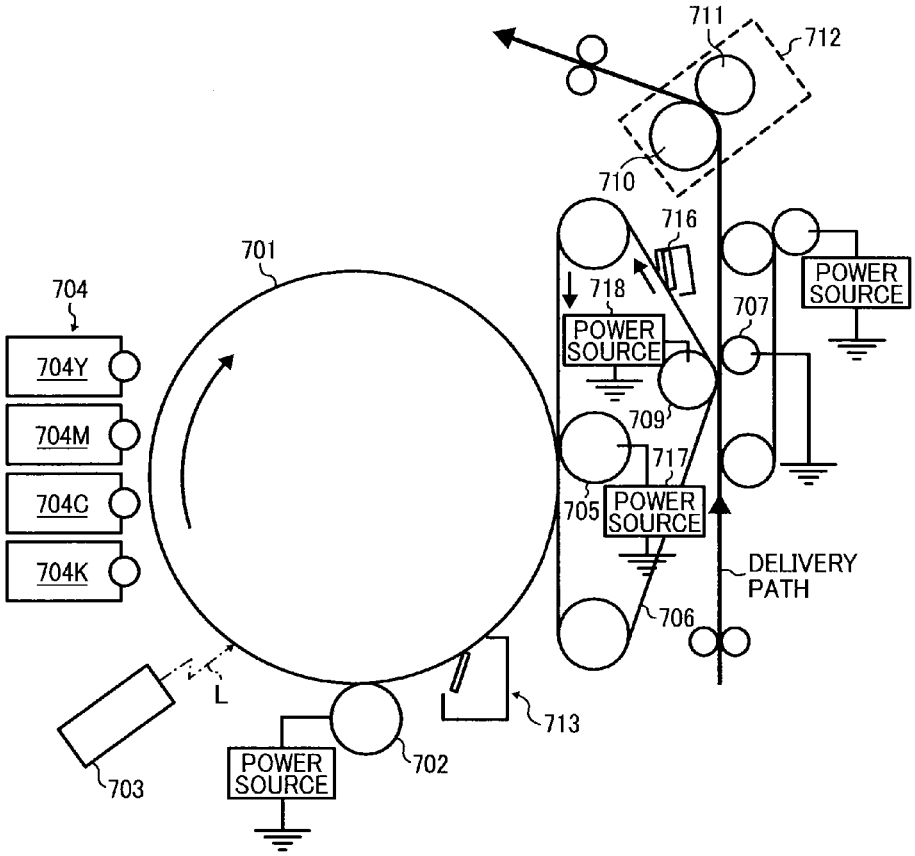
FIG. 19 is a cross-sectional diagram schematically illustrating a color image forming apparatus employing a single drum-type photosensitive member according to an illustrative embodiment of the present invention.

The present invention may be applied to a color image forming apparatus using a single photosensitive member (which may be a photosensitive drum) such as illustrated in FIG. 19. FIG. 19 is a cross-sectional diagram schematically illustrating a color image forming apparatus using a single photosensitive member 701. The image forming apparatus of this type includes one photosensitive drum 701 surrounded by a charging device 702, an exposure device 703, developing devices 704 (704Y, 704C, 704M, 704K), one for each of the colors yellow, magenta, cyan, and black, respectively, and so forth.

When forming an image, the surface of the photosensitive drum 701 is charged uniformly by the charging device 702. Subsequently, the charged surface of the photosensitive drum 701 is illuminated with a modulated light beam L based on image data associated with the color yellow. Accordingly, an electrostatic latent image for the color yellow is formed on the surface of the photosensitive drum 701. The developing unit 704Y develops the electrostatic latent image for yellow with yellow toner, thereby forming a toner image of yellow. As described above, the toner image of yellow formed on the photosensitive drum 701 is transferred primarily onto an intermediate transfer belt 706 by a primary transfer roller 705. After the toner image is transferred onto the intermediate transfer belt 706, residual toner remaining on the photosensitive drum 701 is cleaned by a drum cleaner 713. Subsequently, the surface of the photosensitive drum 701 is uniformly charged by the charging device 702 in preparation for the subsequent imaging process.

Next, the surface of the photosensitive drum 701 is illuminated with the light beam L modulated based on image data associated with the color magenta. Accordingly, an electrostatic latent image for the color magenta is formed on the surface of the photosensitive drum 701. The developing unit 704M develops the electrostatic latent image for magenta with magenta toner, thereby forming a toner image of magenta. As described above, the toner image of magenta formed on the photosensitive drum 701 is transferred onto the intermediate transfer belt 706, such that the toner image of magenta is superimposed on the toner image of yellow. For the colors cyan and black, the toner images of cyan and black are transferred onto the intermediate transfer belt 706 in the similar manner as the color magenta.

As the recording medium is delivered to a secondary transfer nip at which the intermediate transfer belt 706 is interposed between a secondary-transfer back surface roller 709 and a nip forming roller 707, the composite color toner image is transferred onto the recording medium. The recording medium bearing the composite toner image thereon is delivered to a fixing device 712. After transfer, the surface of the intermediate transfer belt 706 is cleaned by a belt cleaner 716 in preparation for subsequent imaging process.

The fixing device 712 includes two rollers 711 and 710, one of which serves as a heating roller and the other roller serves as a pressing roller. The intermediate transfer belt 706 is interposed therebetween. In the fixing device 712, heat and pressure are applied to the recording medium by the rollers 711 and 710 so as to fix the composite toner image on the recording medium. After fixing, the recording medium is output onto a sheet discharge tray, not illustrated.

In the single-drum color image forming apparatus, a power source 718 includes two power sources: a DC power source and an AC power source. The DC power source applies a DC bias. The AC power source applies an AC bias (AC-DC superimposed bias). The power source 718 can switch the transfer bias between the DC bias and the superimposed bias. According to the present illustrative embodiment, similar to the foregoing illustrative embodiments, the transfer mode is changed while the output of the DC power source and the AC power source (superimposed bias power source) is turned off. The same effect as that of the foregoing embodiments can be achieved.

The number of constituent elements, locations, shapes and so forth of the constituent elements are not limited to any of the structure for performing the methodology illustrated in the drawings. For example, registration and editing of the user sheet and the sheet dependent conditions are done using the control panel. Alternatively, registration and editing of the user sheet and the sheet dependent conditions may be performed remotely using a personal computer and a network. Furthermore, setting of each condition, a primary transfer current, a fixing speed, a sheet output speed and so forth may be set individually. Still further, the color mode and the monochrome mode may be set individually. A wide range of adjustment can be performed.

The configuration of the transfer portion is not limited to the configurations described above. The opposing roller may be substituted by a belt member. According to the foregoing illustrative embodiments, the transfer method includes forming a nip at which two opposing members meet and press against each other to transfer a toner image. Alternatively, a contact-free method using a charger may be employed. A known power source may be employed within the scope of the disclosure.

The configuration of the image forming apparatus is not limited to the configurations described above. The order of image forming units arranged in tandem is not limited to the above described order. The present invention may be applicable to an image forming apparatus using toners in three different colors or less. For example, the present invention may be applicable to a multi-color image forming apparatus using two colors of toner and a monochrome image forming apparatus.

According to an aspect of this disclosure, the present invention is employed in the image forming apparatus. The image forming apparatus includes, but is not limited to, a copier, a printer, a facsimile machine, and a multi-functional system.

The DC component bias output from the DC power source may be under constant voltage control. The DC component of the superimposed bias output from the superimposed bias power source may be under constant voltage control. The AC component of the superimposed bias output from the superimposed bias power source may be under constant current control. In a case in which the DC component of the superimposed bias is under constant voltage control, preferably, the DC component value of the transfer bias among the sheet dependent conditions is adjustable per unit of voltage. In a case in which the AC component of the superimposed bias is under constant current control, preferably, the AC component value of the transfer bias among the sheet dependent conditions is adjustable per unit of current.

The above-described image forming apparatus is an example of the image forming apparatus of the present invention. The present invention includes the following embodiments.

According to an aspect of the disclosure, a transfer device includes a sheet dependent condition setting device (for example, the sheet dependent condition setting device 308) to set arbitrarily at least one of the sheet dependent conditions for a recording medium. In this configuration, as described above, when users find image defects in the output image and determine that the cause of the image defects derives from unoptimized sheet dependent conditions at the superimposed-bias transfer mode, the users arbitrarily set at least one of the sheet dependent conditions using the sheet dependent condition setting device. More specifically, the sheet dependent conditions in sheet information stored in the sheet database 303 may be different from optimum sheet dependent conditions, even if the same sheet is used. In this case, the users edit a part of or all sheet dependent conditions for each type of sheet to optimize the sheet dependent conditions. Based on the optimized sheet dependent conditions, the toner image is transferred at the superimposed-bias transfer mode, thereby preventing image defects such as dropouts of toner.

According to an aspect of the disclosure, the sheet dependent condition setting device (308) includes a display device such as a control panel (for example, the display device 304) to display items that guide the users to set at least one of the sheet dependent conditions and an operation device (for example, the operation device 307) through which the users set the sheet dependent conditions. As described above, the sheet dependent conditions corresponding to the present sheet on which an image is formed are obtained from the sheet dependent conditions in the sheet information stored in the sheet database 303.

The obtained sheet dependent conditions and a setup menu for assisting the users to set the sheet dependent conditions are displayed in the dialog box on the control panel. The users select the items shown in the setup dialog box or enter a value of, for example, the DC component voltage and the AC component voltage included in the sheet dependent conditions using a numeric keypad or the like shown in the operation device such as the control panel, thereby allowing the users to edit the sheet dependent conditions to optimize the sheet dependent conditions and hence preventing transfer failure.

According to an aspect of the disclosure, the transfer device includes a sheet dependent condition storage (for example, the sheet data storage device 305) to store preset sheet dependent conditions set for each type of recording medium onto which the toner image is transferred at the superimposed-bias transfer mode. The display device displays the sheet dependent conditions obtained from the sheet dependent condition storage, and the displayed sheet dependent conditions are edited using the operation device. As described above, the sheet dependent conditions obtained from the sheet dependent conditions storage are shown in the screed of the display device. The users edit the sheet dependent conditions shown in the dialog box using the operation device. With this configuration, the users can edit the sheet dependent conditions by simply changing the sheet dependent conditions shown in the dialog box.

According to an aspect of the disclosure, the sheet dependent condition storage stores the sheet dependent conditions set by the sheet dependent condition setting device as the sheet dependent conditions for a new recording medium being set. As described above, the users can optimize the sheet dependent conditions by editing the sheet dependent conditions shown in the setup dialog box using the operation device. Subsequently, the optimized sheet dependent conditions are stored as the sheet dependent conditions for the user sheet in the sheet data storage device 305 or the sheet database 303. With this configuration, upon image formation using the stored user sheet, the sheet dependent conditions for the user sheet stored in the sheet data storage device 305 or the sheet database 303 are obtained and used without changing the conditions so that the sheet dependent conditions are set with ease.

According to an aspect of the disclosure, the sheet dependent conditions include parameters allowing the users to select the DC transfer mode and the superimposed-bias transfer mode switched by the switching device. With this configuration, the transfer mode can be switched between the DC transfer mode and the superimposed-bias transfer mode in accordance with the type of sheet so that optimum image transfer is performed regardless of the type of sheet, thereby producing a high-quality image.

According to an aspect of the disclosure, the transfer device includes an image condition detector (for example, the image condition detector 313) to detect the condition of the toner image transferred on the recording medium. Based on a detection result provided by the image condition detector, the sheet dependent condition setting device sets the sheet dependent conditions to optimize an imaging condition. With this configuration, when the image condition detector detects image defects in an output image and it is determined that the present sheet dependent conditions at the superimposed-bias transfer mode are not appropriate for the sheet, a part of or all the preset image dependent conditions for each type of sheet are optimized automatically. Subsequently, the image transfer is performed at the superimposed-bias transfer mode in accordance with the optimized sheet dependent conditions. Subsequently, the image transfer is performed at the superimposed-bias transfer mode in accordance with the optimized sheet dependent conditions, thereby preventing transfer failure.

According to an aspect of the disclosure, the transfer device applies to a transfer member a DC bias in the DC transfer mode or a superimposed-bias transfer bias in the superimposed-bias transfer mode based on the sheet dependent conditions to transfer the toner image onto a sheet interposed between a transfer nip between an image bearing member and a nip forming member or between a latent image bearing member and a nip forming member. With this configuration, the transfer mode can be switched between the DC transfer mode and the superimposed-bias transfer mode in accordance with the type of sheet so that optimum image transfer is performed regardless of the type of sheet, thereby producing a high-quality image.

According to an aspect of the disclosure, the sheet dependent conditions include at least one of a fixing condition including a fixing temperature of the fixing device and a sheet transport condition including a transport speed of the sheet transport device. With this configuration, the optimum fixing condition and the sheet transport condition are employed for each type of sheet so that high-quality imaging is achieved.

According to an aspect of the disclosure, a toner image developed on the surface of a latent image bearing member is primarily transferred onto an intermediate transfer member serving as the image bearing member, and a primary transfer device serving as the transfer device transfers the toner image from the latent image bearing member to the intermediate transfer member. Subsequently, the toner image is transferred onto a recording medium from the intermediate transfer member by a secondary transfer device. The switching device switches the transfer mode between the DC transfer mode and the superimposed-bias transfer mode so as to change the bias to be applied to the secondary transfer device. With this configuration, in an image forming apparatus using the intermediate transfer method, image transfer is performed at the superimposed-bias transfer mode based on the sheet dependent conditions in the sheet data for the registered user sheet. The image transfer is performed in accordance with the optimized sheet dependent conditions corresponding to the surface condition of the sheet, thereby preventing transfer failure. According to an aspect of the disclosure, a plurality of latent image bearing members is arranged facing the intermediate transfer member. With this configuration, in a tandem-type image forming apparatus, image transfer is performed based on the optimized sheet dependent conditions in the sheet data for the registered user sheet. The image transfer is performed in accordance with the optimized sheet dependent conditions corresponding to the surface condition of the sheet, thereby preventing transfer failure.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A transfer device, comprising:

a transfer member to transfer a toner image formed on an image bearing member onto a recording medium;

a transfer bias power source to apply to the transfer member, based on sheet dependent conditions for the recording medium onto which the toner image is transferred, one of a direct current (DC) transfer bias including a first DC component and a superimposed transfer bias in which an alternating current (AC) component having an AC component value is superimposed on a second DC component having a DC component value;

a switching device to switch a transfer mode between a DC transfer mode in which the DC transfer bias is applied to the transfer device to transfer the toner image onto the recording medium and a superimposed-bias transfer mode in which the superimposed transfer bias is applied to the transfer device to transfer the toner image onto the recording medium;

an image condition detector to detect a condition of the toner image transferred on the recording medium; and a sheet dependent condition setting device to set all of the sheet dependent conditions for the recording medium in the superimposed-bias transfer mode to optimize an imaging condition based on a detection result provided by the image condition detector when the superimposed transfer bias is applied to the transfer member to transfer the toner image onto the recording medium, wherein the sheet dependent conditions include a transport speed of a sheet transport device that transports the recording medium, the DC component value, and the AC component value, the sheet dependent conditions include a parameter allowing a user to select the DC transfer mode and the superimposed-bias transfer mode switched by the switching device, when a user sheet is used, the sheet dependent condition setting device allows the user to set the parameter, and when the user sheet is not used, the sheet dependent condition setting device does not allow a user to set the parameter, but allows the user to select at least any one of a thickness of the recording medium and a sheet type of the recording medium.

2. The transfer device according to claim 1, wherein the sheet dependent condition setting device comprises a display device to display items that guide users to set at least one of the sheet dependent conditions and an operation device through which the users set the sheet dependent conditions.

3. The transfer device according to claim 2, further comprising a sheet dependent condition storage to store preset sheet dependent conditions set for each type of recording medium onto which the toner image is transferred at the superimposed-bias transfer mode, wherein the display device displays the sheet dependent conditions obtained from the sheet dependent condition storage, and the displayed sheet dependent conditions are edited using the operation device.

4. The transfer device according to claim 3, wherein the sheet dependent condition storage stores the sheet dependent conditions set by the sheet dependent condition setting device as the sheet dependent conditions for a new recording medium being set.

5. An image forming apparatus, comprising:

an image bearing member to bear a toner image on a surface thereof;

a nip forming member disposed opposite the image bearing member, to contact the image bearing member to form a transfer nip to interpose a recording medium therebetween;

the transfer device of claim 1 to transfer the toner image on the image bearing member onto the recording medium at the transfer nip;

a fixing device to fix the toner image on the recording medium; and a sheet transport device to transport the recording medium.

6. The image forming apparatus according to claim 5, wherein the sheet dependent conditions include a fixing condition including a fixing temperature of the fixing device.

7. The transfer device according to claim 1, wherein the transfer bias power source is turned off while the switching device switches between transfer modes.

8. An image forming apparatus, comprising:

an image bearing member to bear a toner image on a surface thereof;

a transfer member to transfer the toner image formed on the image bearing member onto a recording medium;

a transfer bias power source to apply, to the transfer member, based on sheet dependent conditions for the recording medium onto which the toner image is transferred, a superimposed transfer bias in which an alternating current (AC) component having an AC component value is superimposed on a direct current (DC) component having a DC component value;

a fixing device to fix the toner image on the recording medium;

an image condition detector to detect a condition of the toner image transferred on the recording medium; and a sheet dependent condition setting device to set all of the sheet dependent conditions for the recording medium to optimize an imaging condition based on a detection result provided by the image condition detector, wherein the sheet dependent conditions include a transport speed of a sheet transport device that transports the recording medium, a fixing temperature of the fixing device, the DC component value, and the AC component value, the sheet dependent conditions include a parameter allowing a user to select the DC transfer mode and the superimposed-bias transfer mode switched by the switching device, when a user sheet is used, the sheet dependent condition setting device allows the user to set the parameter, and when the user sheet is not used, the sheet dependent condition setting device does not allow a user to set the parameter, but allows the user to select at least any one of a thickness of the recording medium and a sheet type of the recording medium.

9. The image forming apparatus according to claim 8, wherein the transfer member is disposed opposite the image bearing member, to contact the image bearing member to form a transfer nip to interpose the recording medium therebetween.

10. The image forming apparatus according to claim 8, further comprising a nip forming member disposed opposite the image bearing member, to contact the image bearing member to form a transfer nip to interpose the recording medium therebetween, wherein the transfer member is disposed opposite the nip forming member via the image bearing member.

11. A transfer device, comprising:

a transfer member to transfer a toner image formed on an image bearing member onto a recording medium;

a transfer bias power source to apply to the transfer member, based on sheet dependent conditions for the recording medium onto which the toner image is transferred, one of a direct current (DC) transfer bias including a DC component and a superimposed transfer bias in which an alternating current (AC) component is superimposed on a DC component; and a sheet dependent condition setting device to set the sheet dependent conditions for the recording medium, wherein the sheet dependent conditions include a level of the DC component, a level of the AC component, and a parameter to select a transfer bias output from the transfer bias power source between the DC transfer bias and the superimposed transfer bias, when a user sheet is used, the sheet dependent condition setting device allows a user to set the parameter, and when the user sheet is not used, the sheet dependent condition setting device does not allow a user to set the parameter, but allows the user to select at least any one of a thickness of the recording medium and a sheet type of the recording medium.

* * * * *